US008045871B2

(12) United States Patent
Monma et al.

(10) Patent No.: US 8,045,871 B2
(45) Date of Patent: Oct. 25, 2011

(54) IMAGE FORMING APPARATUS AND IMAGE FORMING METHOD ON MEASURED PHYSICAL QUANTITY

(75) Inventors: Susumu Monma, Ibaraki (JP); Shinya Kobayashi, Ibaraki (JP); Shinichi Akatsu, Ibaraki (JP); Teruaki Mitsuya, Ibaraki (JP); Makoto Yagawara, Ibaraki (JP); Hideharu Miki, Ibaraki (JP); Isao Nakajima, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 715 days.

(21) Appl. No.: 12/138,507

(22) Filed: Jun. 13, 2008

(65) Prior Publication Data

US 2008/0317486 A1 Dec. 25, 2008

(30) Foreign Application Priority Data

Jun. 15, 2007 (JP) ..... 2007-159033
Jun. 15, 2007 (JP) ..... 2007-159034
May 26, 2008 (JP) ..... 2008-136856

(51) Int. Cl.
*G03G 15/00* (2006.01)
*G03G 15/01* (2006.01)

(52) U.S. Cl. ..... 399/49; 399/301

(58) Field of Classification Search ..... 399/49, 399/301

See application file for complete search history.

(56) References Cited

U.S. PATENT DOCUMENTS 5,087,942 A 2/1992 Rushing
5,122,835 A 6/1992 Rushing et al.
5,124,732 A 6/1992 Manzer et al.
6,434,348 B1 8/2002 Tomizawa
6,633,734 B2 10/2003 Maebashi et al.
6,804,479 B2 10/2004 Kimura
7,162,171 B2 1/2007 Sugiyama
7,194,214 B2 3/2007 Takahashi
7,324,769 B2 * 1/2008 Yamaoka ..... 399/49
7,471,908 B2 * 12/2008 Soya et al. ..... 399/49
7,773,896 B2 * 8/2010 Yagawara et al. ..... 399/49
2003/0137577 A1 7/2003 Shinohara
2007/0212086 A1 9/2007 Yagawara et al.

FOREIGN PATENT DOCUMENTS

JP 05-333652 12/1993
JP 07-181795 7/1995
JP 2001-194850 7/2001
JP 2003-186278 A 7/2003
JP 2006-084796 3/2006
JP 2007-272193 A 10/2007
JP 2008-216600 A 9/2008

* cited by examiner

*Primary Examiner* — William J Royer

(74) *Attorney, Agent, or Firm* — Ladas & Parry LLP

(57) ABSTRACT

An image forming apparatus for performing an image forming operation is disclosed that includes an image carrier on which a toner image is formed, an intermediate transfer member configured to transfer the toner image to a recording medium, the intermediate transfer member having a toner image forming area including an output image forming area and a non-output image forming area located outside of the output image forming area, the toner image forming area being wider than the output image forming area, and a detecting part configured to measure a physical quantity regarding an image quality of a first reference image formed in the output image forming area and a second reference image formed in the non-output image forming area.

20 Claims, 15 Drawing Sheets

IMAGE FORMING APPARATUS AND IMAGE FORMING METHOD ON MEASURED PHYSICAL QUANTITY

BACKGROUND OF THE INVENTION

1. Field of the Invention

The present invention relates to an image forming apparatus such as an electrophotographic type image forming apparatus and an image forming method thereof.

2. Description of the Related Art

Image quality of output images formed by recent image forming apparatuses has significantly improved. Thus, demands for higher image quality control by the user are becoming greater. Nevertheless, image forming apparatuses of an electrophotographic type using an electrostatic process face a problem of changes of image quality due to, for example, environmental changes (e.g., temperature, humidity) and degradations with age (e.g., degradation of toner). Particularly, change of toner density is a problem in a case of forming monochrome images. Furthermore, in addition to change of toner density, change of color reproduction, change of gradation, and change in the amount of color registration are problems in a case of forming color images.

As a commonly used method for resolving such changes of image quality, there is, for example, a method of forming an output image based on image data dedicated for printing along with forming an image based on a relatively small pattern(s) dedicated for image quality management (hereinafter also referred to as "reference image") on a photoconductor and/or a image transfer medium, measuring a physical quantity (e.g. amount of adhered toner, gradation, amount of color registration) regarding the image quality of the reference image by using a sensor, and controlling image forming conditions (e.g., electric potential for charging a photoconductor, amount of light to be emitted to the photoconductor, developing bias, amount of development toner to be supplied) based on values obtained by the measurement of a physical quantity. With this method of controlling image quality, changes of image quality can be precisely controlled with high accuracy. In a case where the image quality controlling method using the reference image is performed by an image forming apparatus that forms an image on a plain paper (cut-sheet) sheet by sheet such as on A4 size paper, the reference image is formed in an area between output images on a photoconductor drum or a transfer belt, to thereby measure the physical quantity and control various image forming conditions (see, for example, Japanese Laid-Open Patent Application No. 7-181795). On the other hand, in a case where the image quality controlling method using the reference image is performed by an image forming apparatus that forms an image on continuous form paper, the reference image is formed in an area outside of an output image forming area (non-output image forming area) since the output image forming area is constantly used for printing an output image (see, for example, U.S. Pat. No. 5,124,732).

In a case where an output image is continuously formed, for example, a case of forming an image on continuous form paper on an intermediate transfer belt, the surface conditions of the intermediate transfer belt vary between its output image forming area and its non-output image forming area. The output image forming area of the intermediate transfer belt is constantly in contact with a recording medium (sheet) and subject to friction and changes of charge, whereas the non-output image forming area does not contact a recording medium (sheet) and is subject to relatively moderate conditions. Therefore, in a case of forming the same image in the output image forming area and the non-output image forming area, the image formed in the output image forming area and the image formed in the non-output image forming area may not have the same image quality depending on the operating state of the image forming apparatus. Thus, in a case where there is a significant difference of measured image quality between the output image formed in the output image forming area and the reference image formed in the non-output image forming area, the image quality of the output image formed in the output image forming area cannot be sufficiently controlled even if control efforts are based on data of the physical quantity obtained from the reference image formed in the non-output image forming area.

When forming (printing) an image on a continuous paper where its image quality is controlled by forming a reference image in an output image forming area for controlling image quality with high precision, it becomes necessary to interrupt the continuous printing process. This interruption of the printing process lowers printing efficiency particularly in a case of printing large amounts of continuous paper at high speed.

Therefore, in a case of forming large amounts of images on a continuous paper at high speed, it is difficult to achieve both precise monitoring of image quality of an output image being printed and forming a reference image used for the image quality monitoring while forming the output image.

SUMMARY OF THE INVENTION

The present invention may provide an image forming apparatus and an image forming method that substantially obviate one or more of the problems caused by the limitations and disadvantages of the related art.

Features and advantages of the present invention are set forth in the description which follows, and in part will become apparent from the description and the accompanying drawings, or may be learned by practice of the invention according to the teachings provided in the description. Objects as well as other features and advantages of the present invention will be realized and attained by an image forming apparatus and an image forming method particularly pointed out in the specification in such full, clear, concise, and exact terms as to enable a person having ordinary skill in the art to practice the invention.

To achieve these and other advantages and in accordance with the purpose of the invention, as embodied and broadly described herein, an embodiment of the present invention provides an image forming apparatus for performing an image forming operation, the image forming apparatus including: an image carrier on which a toner image is formed; an intermediate transfer member configured to transfer the toner image to a recording medium, the intermediate transfer member having a toner image forming area including an output image forming area and a non-output image forming area located outside of the output image forming area, the toner image forming area being wider than the output image forming area; and a detecting part configured to measure a physical quantity regarding an image quality of a first reference image formed in the output image forming area and a second reference image formed in the non-output image forming area.

In the image forming apparatus according to an embodiment of the present invention, the physical quantity may be an amount of adhered toner in the first reference image or the second reference image.

In the image forming apparatus according to an embodiment of the present invention, the physical quantity may be an amount of color registration in the first reference image or the second reference image.

The image forming apparatus according to an embodiment of the present invention may further include an image quality controlling device configured to correct a reference value of the physical quantity of the second reference image according to the physical quantity of the first reference image when the image forming operation is stopped and control the image quality of an output image to be formed in the output image forming area according to the corrected reference value and the physical quantity of the second reference image.

The image forming apparatus may further include a toner discharge image forming part configured to form a toner discharge image; wherein the image carrier has a toner discharge image forming area corresponding to the non-output image forming area of the intermediate transfer member; wherein the toner discharge image is formed in at least one of the toner discharge image forming area of the image carrier and the non-output image forming area of the intermediate transfer member.

Furthermore, another embodiment of the present invention provides an image forming method for performing an image forming operation, the image forming method including the steps of: forming a toner image on an image carrier; transferring the toner image to a recording medium via an intermediate transfer member having a toner image forming area including an output image forming area and a non-output image forming area located outside of the output image forming area, the toner image forming area being wider than the output image forming area; and measuring a physical quantity regarding an image quality of a first reference image formed in the output image forming area and a second reference image formed in the non-output image forming area.

In the image forming method according to an embodiment of the present invention, the physical quantity may be at least one of an amount of adhered toner and an amount of color registration.

The image forming method according to an embodiment of the present invention may further include the steps of: correcting a reference value of the physical quantity of the second reference image according to the physical quantity of the first reference image when the image forming operation is stopped; and controlling the image quality of an output image to be formed in the output image forming area according to the corrected reference value and the physical quantity of the second reference image.

The image forming method according to an embodiment of the present invention may further include a step of: forming a toner discharge image; wherein the image carrier has a toner discharge image forming area corresponding to the non-output image forming area of the intermediate transfer member; wherein the toner discharge image is formed in at least one of the toner discharge image forming area of the image carrier and the non-output image forming area of the intermediate transfer member.

Furthermore, another embodiment of the present invention provides an image forming apparatus for performing an image forming operation, the image forming apparatus including: an image carrier on which a toner image is formed, the image carrier having a first toner image forming area including a first output image forming area and a first non-output image forming area located outside of the first output image forming area, the first toner image forming area being wider than the first output image forming area; an intermediate transfer member configured to transfer the toner image to a recording medium, the intermediate transfer member having a second toner image forming area including a second output image forming area and a second non-output image forming area located outside of the second output image forming area, the second toner image forming area being wider than the second output image forming area; and a detecting part configured to measure a physical quantity regarding an image quality of a first reference image formed in the first and second output image forming areas and a second reference image formed in the first and second non-output image forming areas.

In the image forming apparatus according to an embodiment of the present invention, the physical quantity regarding the image quality of the first reference image formed on the intermediate transfer member may be an amount of adhered toner in the first reference image formed on the intermediate transfer member and the physical quantity regarding the image quality of the second reference image formed on the intermediate transfer member is an amount of adhered toner in the second reference image formed on the intermediate transfer member.

In the image forming apparatus according to an embodiment of the present invention, the physical quantity regarding the image quality of the first reference image formed on the image carrier may be an amount of color registration in the first reference image formed on the image carrier and the physical quantity regarding the image quality of the second reference image formed on the image carrier is an amount of color registration in the second reference image formed on the image carrier.

The image forming apparatus according to an embodiment of the present invention may further include: an image quality controlling device configured to correct a reference value of the physical quantity of the second reference image according to the physical quantity of the first reference image when the image forming operation is stopped and control the image quality of an output image to be formed in the output image forming area according to the corrected reference value and the physical quantity of the second reference image.

The image forming apparatus according to an embodiment of the present invention may further include: a toner discharge image forming part configured to form a toner discharge image; wherein the image carrier has a toner discharge image forming area corresponding to the second non-output image forming area of the intermediate transfer member; wherein the toner discharge image is formed in at least one of the toner discharge image forming area of the image carrier and the second non-output image forming area of the intermediate transfer member.

Furthermore, another embodiment of the present invention provides an image forming method for performing an image forming operation, the image forming method including the steps of: forming a toner image on an image carrier, the image carrier having a first toner image forming area including a first output image forming area and a first non-output image forming area located outside of the first output image forming area, the first toner image forming area being wider than the first output image forming area; transferring the toner image to a recording medium with an intermediate transfer member, the intermediate transfer member having a second toner image forming area including a second output image forming area and a second non-output image forming area located outside of the second output image forming area, the second toner image forming area being wider than the second output image forming area; and measuring a physical quantity regarding an image quality of a first reference image formed in the first and second output image forming areas and a second reference image formed in the first and second non-output image forming areas.

In the image forming method according to an embodiment of the present invention, the physical quantity regarding the image quality of the first reference image formed on the intermediate transfer member may be an amount of color registration in the first reference image formed on the intermediate transfer member and the physical quantity regarding the image quality of the second reference image formed on the intermediate transfer member is an amount of color registration in the second reference image formed on the intermediate transfer member, wherein the physical quantity regarding the image quality of the first reference image formed on the image carrier is an amount of adhered toner in the first reference image formed on the image carrier and the physical quantity regarding the image quality of the second reference image formed on the image carrier is an amount of adhered toner in the second reference image formed on the image carrier.

The image forming method according to an embodiment of the present invention may further include the steps of: correcting a reference value of the physical quantity of the second reference image according to the physical quantity of the first reference image when the image forming operation is stopped; and controlling the image quality of an output image to be formed in the output image forming area according to the corrected reference value and the physical quantity of the second reference image.

The image forming apparatus according to an embodiment of the present invention may further include: three or more of the detecting parts configured to measure the physical quantity regarding the image quality of a corresponding reference image; and a selecting part configured to select the detecting part located in the output image forming area and two of the detecting parts located closest to the corresponding ends of the recording medium in the non-image forming area when the width of the output image forming area and the width of the non-output image forming area are changed in correspondence with a change of width of the recording medium; wherein the selected detecting part measures the physical quantity regarding the image quality of a corresponding reference image when the image forming operation is stopped.

In the image forming apparatus according to an embodiment of the present invention, the detecting part may be configured to measure the physical quantity regarding the image quality of the first reference image formed in the second output image forming area until the length of the recording medium on which the image forming operation is performed reaches a predetermined length and measure the physical quantity regarding the image quality of the reference images of the intermediate transfer member until the length of the recording medium on which the image forming operation is performed is no greater than a predetermined length and measure the physical quantity regarding the image quality of the reference images of the image carrier after the length of the recording medium on which the image forming operation is performed is greater than the predetermined length.

In the image forming apparatus according to an embodiment of the present invention, the predetermined length may range from 500 m to 2 km.

Other objects, features and advantages of the present invention will become more apparent from the following detailed description when read in conjunction with the accompanying drawings.

DETAILED DESCRIPTION OF THE PREFERRED EMBODIMENTS (Overview of Image Forming Apparatus)

Figure 1:
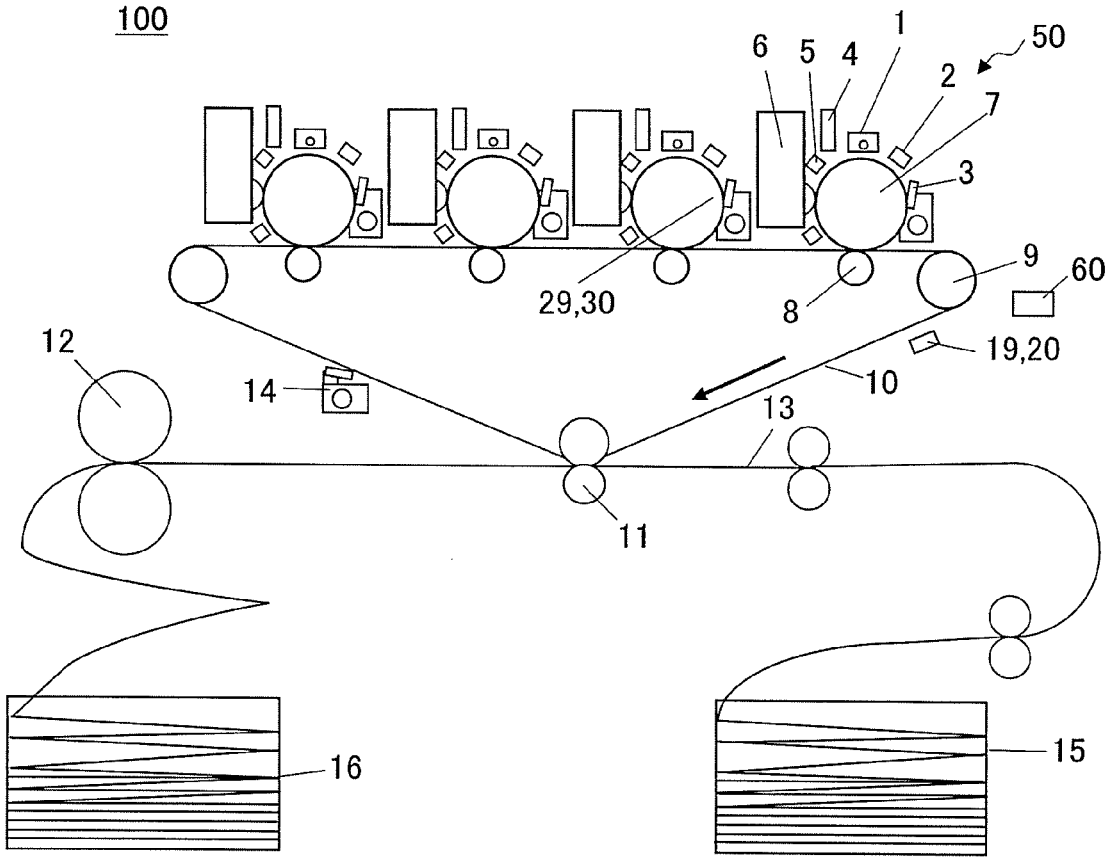
FIG. 1 is a schematic diagram showing an image forming apparatus according to an embodiment of the present invention.

FIG. 1 is a schematic diagram showing an image forming apparatus 100 according to an embodiment of the present invention. The image forming apparatus 100 can perform continuous form printing. The image forming apparatus 100 includes, for example, an image quality controlling device 60 for performing various controls such as correcting of a reference value and controlling of image quality (described in detail below), and development units 50 for forming four color toner images of black, cyan, magenta, and yellow and an intermediate transfer belt 10. The development units 50 corresponding to the four colors are sequentially arranged in a manner facing the intermediate transfer belt (intermediate image carrier) 10. Accordingly, toner images of each color are sequentially transferred superposed onto the intermediate transfer belt 10, to thereby form a full color toner image.

Then, the full color toner image on the intermediate transfer belt 10 is transferred to a continuous sheet (recording medium) 13 conveyed from a pre-printing sheet installation part 15 by a second transfer roller (second transferring part) 11. Then, the toner image transferred to the continuous sheet 13 is melted and fixed onto the continuous sheet 13 by applying heat and pressure to the toner image with a fixing apparatus 12, to thereby form a color image on the continuous sheet 13. Then, the continuous sheet 13 is discharged to a post-printing sheet installation part 16.

Generally, a full color image forming apparatus 100 has development units 50 including photoconductor drums (photoconductor part) 7 corresponding to each color. In this example, the development units 50 include a black (K) development unit containing a black toner, a cyan (C) development unit containing a cyan toner, a magenta (M) development unit containing a magenta toner, and a yellow (Y) development unit containing a yellow toner (Y). Each development unit 50 includes, for example, a charger 1 for charging the photoconductor drum 7, an exposing device 4 for forming (writing) an electrostatic image on the photoconductor drum 7, an electric potential sensor 5 for detecting the electric potential of the charge applied to the photoconductor drum 7 and the electric potential of a charge discharged from the photoconductor drum 7, a developing device 6 for forming a toner image by supplying toner to the electrostatic image on the photoconductor drum 7, a first transfer roller (first transferring part) 8 for transferring the toner image from the photoconductor drum 7 to the intermediate transfer belt 10, a cleaner 3 for cleaning the surface of the photoconductor drum 7 after transferring the toner image to the intermediate transfer belt 10, and a charge removing part 2 for removing the electrostatic image remaining on the photoconductor drum 7. The developing device 6 includes, for example, a toner hopper for storing toner and a developer roller for forming a toner layer that contacts the photoconductor drum 7.

In this embodiment of the present invention, the intermediate transfer belt 10 is an endless belt rotated in an arrow direction in FIG. 1 by the rotation of a driving roller 9 driven by a driving part (not shown). The first transfer rollers 8 are situated at an inner side of the intermediate transfer belt 10 in a manner facing corresponding photoconductor drums 7 of the development units 50. By using the first transfer rollers 8, the toner images formed on the photoconductor drums 7 are sequentially transferred to the intermediate transfer belt 10. Accordingly, a full color toner image is formed, for example, by superposing the toner images corresponding to the four colors onto the intermediate transfer belt 10. Then, the full color toner image is conveyed to a nipping part between the intermediate transfer belt 10 and the second transfer roller 11 by the rotation of the intermediate transfer belt 10. The continuous sheet 13 is pulled out from the pre-printing sheet installation part 15 and conveyed to the nipping part between the intermediate transfer belt 10 and the second transfer roller 11. At the nipping part, the continuous sheet 13 is arranged in a manner having its front side facing the intermediate transfer belt 10 and its back side facing the second transfer roller 11. Accordingly, the full color toner image is transferred from the intermediate transfer belt 10 to the continuous sheet 13 at the nipping part. Then, residual toner (untransferred toner) remaining on the surface of the intermediate transfer belt 10 is removed by a belt cleaner 14. Then, the continuous sheet 13 having the toner image transferred thereto is conveyed to the fixing apparatus 12. Then, the fixing apparatus 12 fixes the toner image onto the continuous paper 13. Then, the continuous sheet 13 is guided to the post-printing sheet installation part 16.

(Forming an Image on a Continuous Sheet)

In a case of forming an image on a continuous sheet 13, first, the photoconductor drum 7 is charged by the charger 1. Then, the electric potential on the photoconductor drum 7 is lowered by exposing a predetermined part of the photoconductor drum 7 with light from the exposing device 4 in correspondence with the image to be formed. The photoconductor drum 7 is rotated so that the exposed part contacts a toner layer formed by the developing device 6. When the exposed part contacts the toner layer, toner adheres to the exposed area, to thereby form a toner image on the photoconductor drum 7. Then, the toner image is transferred to the intermediate transfer belt 10 at an area where the first transfer roller 8 presses the intermediate transfer belt 10 toward the photoconductor drum 7.

The toner image on the photoconductor drum 7 corresponding to the developing unit 50 of each color is sequentially transferred to the intermediate transfer belt 10, to thereby form a color toner image. Then, the intermediate transfer belt 10 conveys the color toner image to an area where the intermediate transfer belt 10 contacts the second transfer roller 11. Accordingly, upon reaching the contacting area, the color toner image is transferred from the intermediate transfer belt 10 to the continuous sheet 13. Then, the fixing apparatus 12 applies heat and pressure to the toner image, to thereby melt and fix the toner image onto the continuous sheet 13.

Next, an adjustment of image quality is described with reference to the above-described image forming apparatus according to an embodiment of the present invention.

First Embodiment

[Forming of a Reference Image Outside of an Output Image Forming Area]

Figure 2:
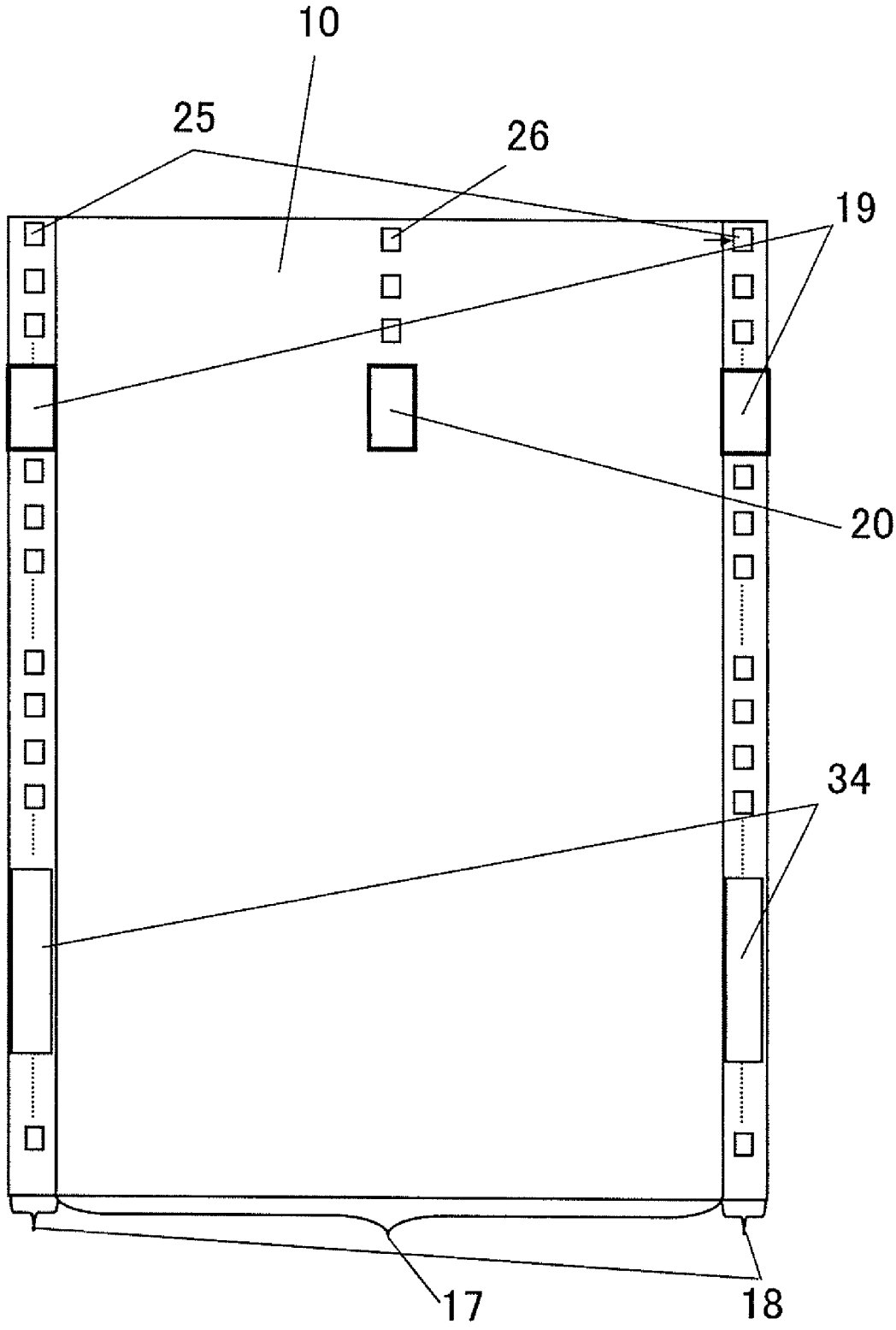
FIG. 2 is a plan view showing a positional relationship between an intermediate transfer belt and sensors according to an embodiment of the present invention.
Figure 3:
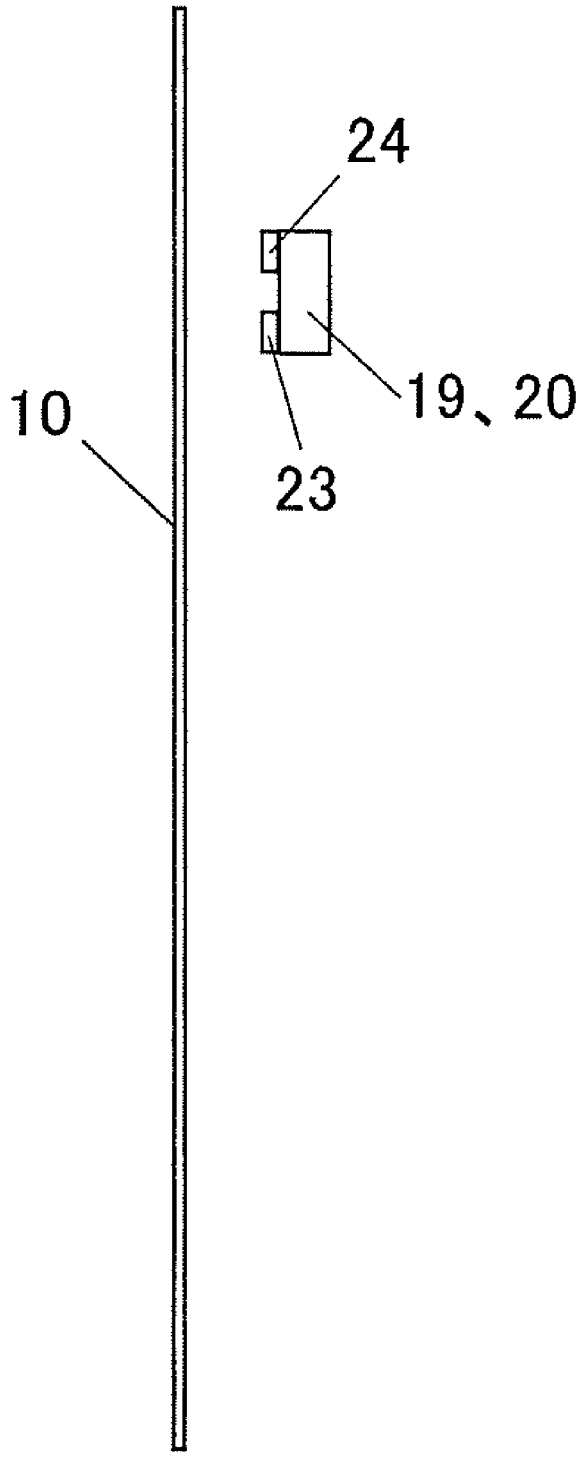
FIG. 3 is a side view of the configuration shown in FIG. 2.

In the example shown in FIG. 2, there are three areas on the intermediate transfer belt 10 where a reference image 25, 26 is formed. FIG. 2 is a plan view of a toner image forming area of the intermediate transfer belt 10 according to an embodiment of the present invention. FIG. 3 is a side view of the configuration shown in FIG. 2. It is to be noted that FIGS. 2 and 3 also illustrate sensors 19, 20 used for measuring the physical quantity of the reference images 25, 26. As shown in FIG. 2, the reference image 25 is formed in an area outside of an output image forming area 17. That is, the reference image 25 is formed in a non-output image forming area 18 situated at both end parts of the intermediate transfer belt 10 outside the maximum width of an image transferring area of the intermediate transfer belt 10 where an output image can be transferred to the continuous sheet 13. The reference image 26 is formed in an area inside the output image forming area 17 situated at the center part of the intermediate transfer belt 10 where an output image can be transferred to the continuous sheet 13.

It is to be noted that, although the reference image 26 according to an embodiment of the present invention is located at a center part inside the output image forming area 17 with respect to the width direction of the intermediate transfer belt 10, the reference image 26 may be formed in parts other than the center part of the intermediate transfer belt 10. Furthermore, the reference image 26 may be formed in plural parts of the intermediate transfer belt 10. Furthermore, although it is preferable to provide the reference image 25 at both end parts of the intermediate transfer belt 10, the reference image 25 may be provided on either one of the end parts. It is to be noted that an output image is an image to be formed (output) to a target printing material by transferring the image to a recording medium (e.g., continuous sheet 13) and fixing the image to the recording medium with the image forming apparatus 100, whereas a reference image is an image to be used for evaluating the quality of an image formed by the image forming apparatus 100. Accordingly, the physical quantity regarding the image quality of the reference image having a predetermined value can be an indication of a normal image forming operation. It is to be noted that the reference image according to an embodiment of the present invention is only needed to be formed on the photoconductor drum 7 or the intermediate transfer belt (intermediate transfer member) 10 and is not needed to be transferred to a recording medium. The reference image according to an embodiment of the present invention can be removed from the photoconductor drum 7 or the intermediate transfer belt (intermediate transfer member) 10 by a cleaner.

[Sensor]

Near the intermediate transfer belt 10 according to an embodiment of the present invention, the sensor 19 is arranged in a manner facing the reference image 25 located in the non-output image forming area 18 (i.e. area outside the output image forming area 17), and the sensor 20 is arranged in a manner facing the reference image 26 located in the output image forming area 17 (i.e. area inside the output image forming area 17). Although the sensor 20 is arranged at the center of the output image forming area 17, the sensor 20 may be arranged at an area other than the center of the output image forming area 17. It is preferable that the sensor 20 be arranged at a position corresponding to a printing area.

The sensors 19 and 20 are mounted (supported) on a main body of the image forming apparatus 100. Thus, the sensors 19 and 20 constantly face substantially the same area of the intermediate transfer belt 10 with respect to the width direction of the intermediate transfer belt 10 even where the intermediate transfer belt 10 is rotated. Accordingly, as shown in FIGS. 2 and 3, the reference images 25 and 26 are successively conveyed to the area facing the sensors 19, 20 along with the rotation of the intermediate transfer belt 10. In this embodiment of the present invention, each of the sensors 19 and 20 is configured as a non-contact type sensor including a light emitting part 23 and a light receiving part 24. The sensors 19, 20 may be optical sensors used for specular reflection where the angle of incidence equals the angle of reflection or an optical sensor used for diffused reflection where incoming light is reflected in a broad range of directions. The target measured by the sensors 19, may be any kind of physical quantity that directly or indirectly serves as an index of image quality. For example, the amount of color registration, the amount of adhered toner, or gradation may be measured by the sensors 19, 20.

The sensors 19, 20 may measure only the amount of adhered toner in a case where the image forming apparatus is configured to form a single color image (e.g., monochrome printing).

[Control of Image Quality by Using a Reference Image During Printing]

When an output image is being printed, the output image forming area 17 of the intermediate transfer belt 10 is substantially constantly being used. That is, an output image is printed by forming an image in the output image forming area 17 and transferring the image to a continuous sheet (recording medium) 13. Therefore, during an operation of continuously printing an output image, no image except for the output image can be formed in the output image forming area 17. Therefore, the reference image 25 is formed in the non-output image forming area 18 of the intermediate transfer belt 10 during the printing operation. Accordingly, the sensor 19 corresponding to the reference image 25 measures physical quantities (e.g., amount of adhered toner, amount of color registration) of cyan (C), magenta (M), yellow (Y), and black (K).

In controlling the amount of toner, image forming conditions corresponding to each developing unit 50 (e.g., electric potential for charging a photoconductor drum 7, amount of light to be emitted to the photoconductor drum 7, developing bias, amount of development toner to be supplied) are controlled by comparing a measured value and a reference value. Thereby, changes in the amount of toner can be prevented. Examples for controlling the amount of adhered toner are described below.

(1) Controlling Development Potential

In this example, plural toner images (toner patterns) having different amounts of adhered toner are formed by changing the output of development bias voltage between plural levels while the power of a light source (LD) and the charging voltage are fixed. Accordingly, the development potential is determined by adjusting the development bias voltage so that the amount of adhered toner detected by a photosensor becomes a desired value.

(2) Setting a Reference Value for Controlling Toner Density

The level for controlling toner density may be changed due to a decrease in the charge of toner. Therefore, in this example, a reference value of a toner density sensor for controlling toner density is optimized by detecting an adhered toner pattern with an optical sensor and detecting toner density in a developing device based on the results detected by the optical sensor.

(3) Agitating Developer

In this example, the developer is agitated by rotating an agitating member inside a developing device for restoring the charge of the toner.

(4) Controlling Toner Supply

In this example, a toner supplying motor is driven by calculating toner supply time based on output from a toner density detecting sensor, a reference value of a toner density control, and pixel detection data.

(5) Controlling Correction of Halftone

In this example, an optical sensor is used to detect plural adhered toner patterns formed by outputting a predetermined development bias and a charge voltage and changing the power of a light source (LD). Accordingly, input/output development characteristic are obtained based on the output of the optical sensor, to thereby change the power of the light source (LD) so that desired input/output development characteristics can be attained.

(6) Controlling Shading

In this example, the light output of an optical source (LD) corresponding to a single scan is controlled for reducing uneven amounts of toner adhered in a main scanning direction.

Figure 6:
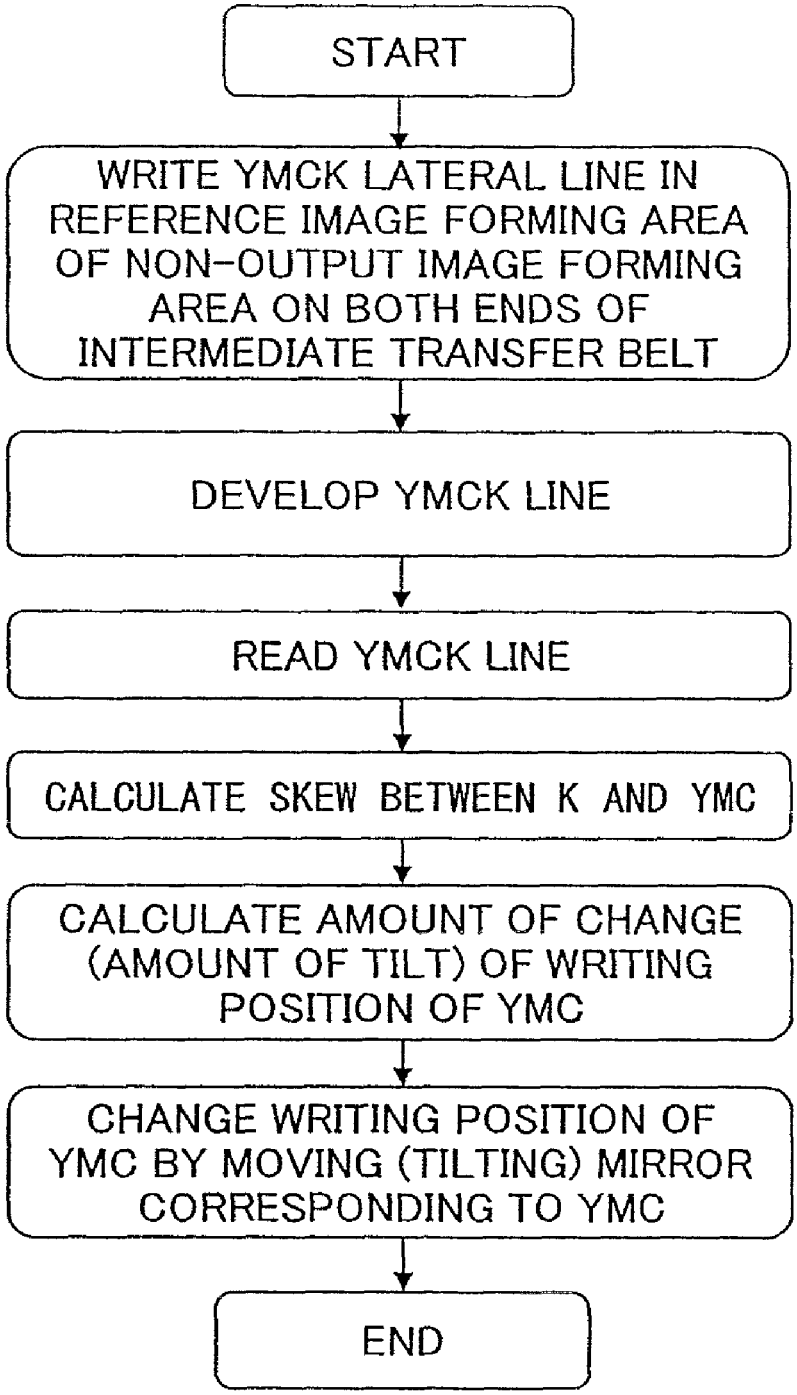
FIG. 6 is a flowchart for describing correction of color registration by using skew control according to an embodiment of the present invention.
Figure 7:
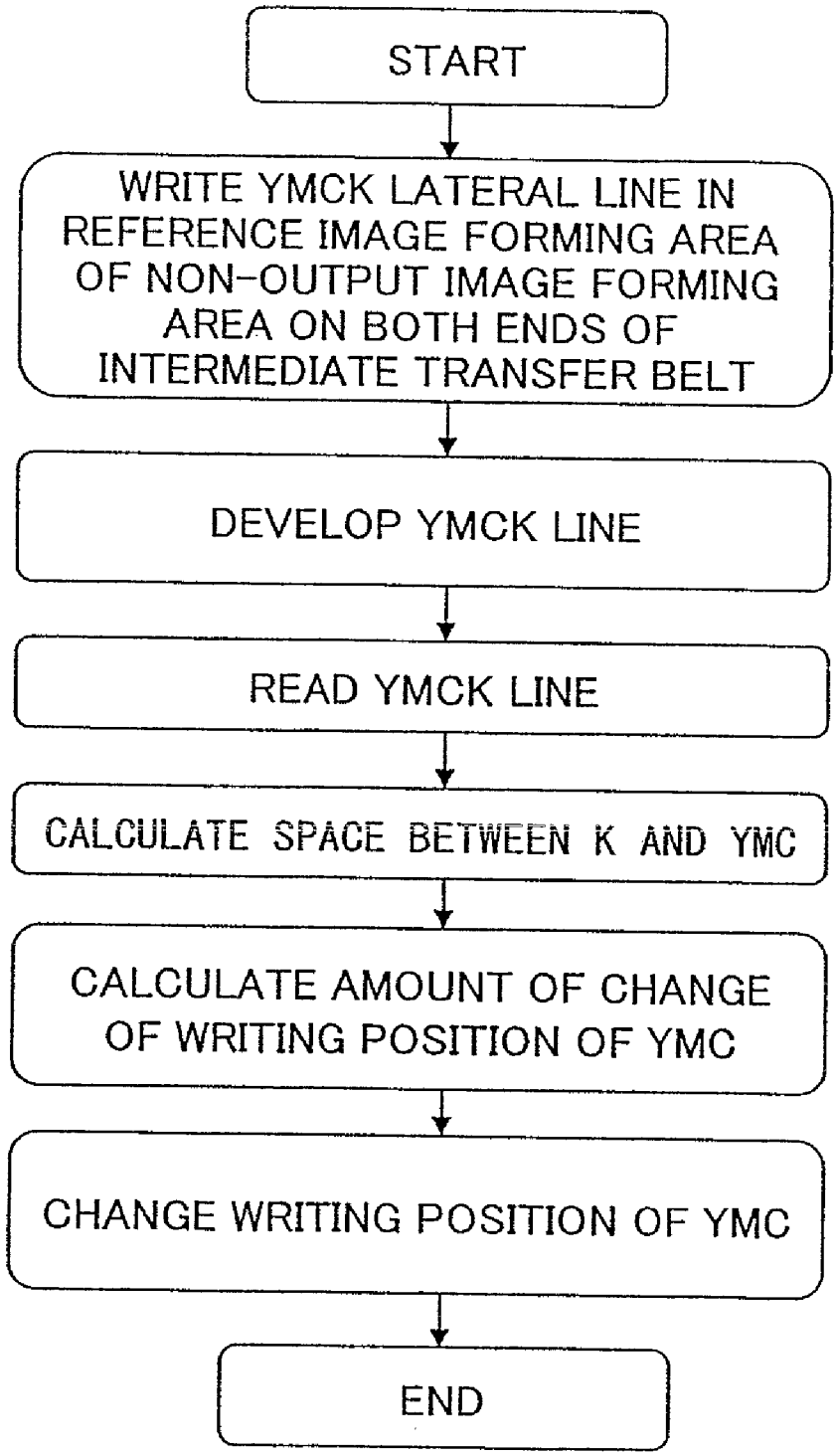
FIG. 7 is a flowchart for describing correction of color registration by using interval control of YMCK according to an embodiment of the present invention.
Figure 8:
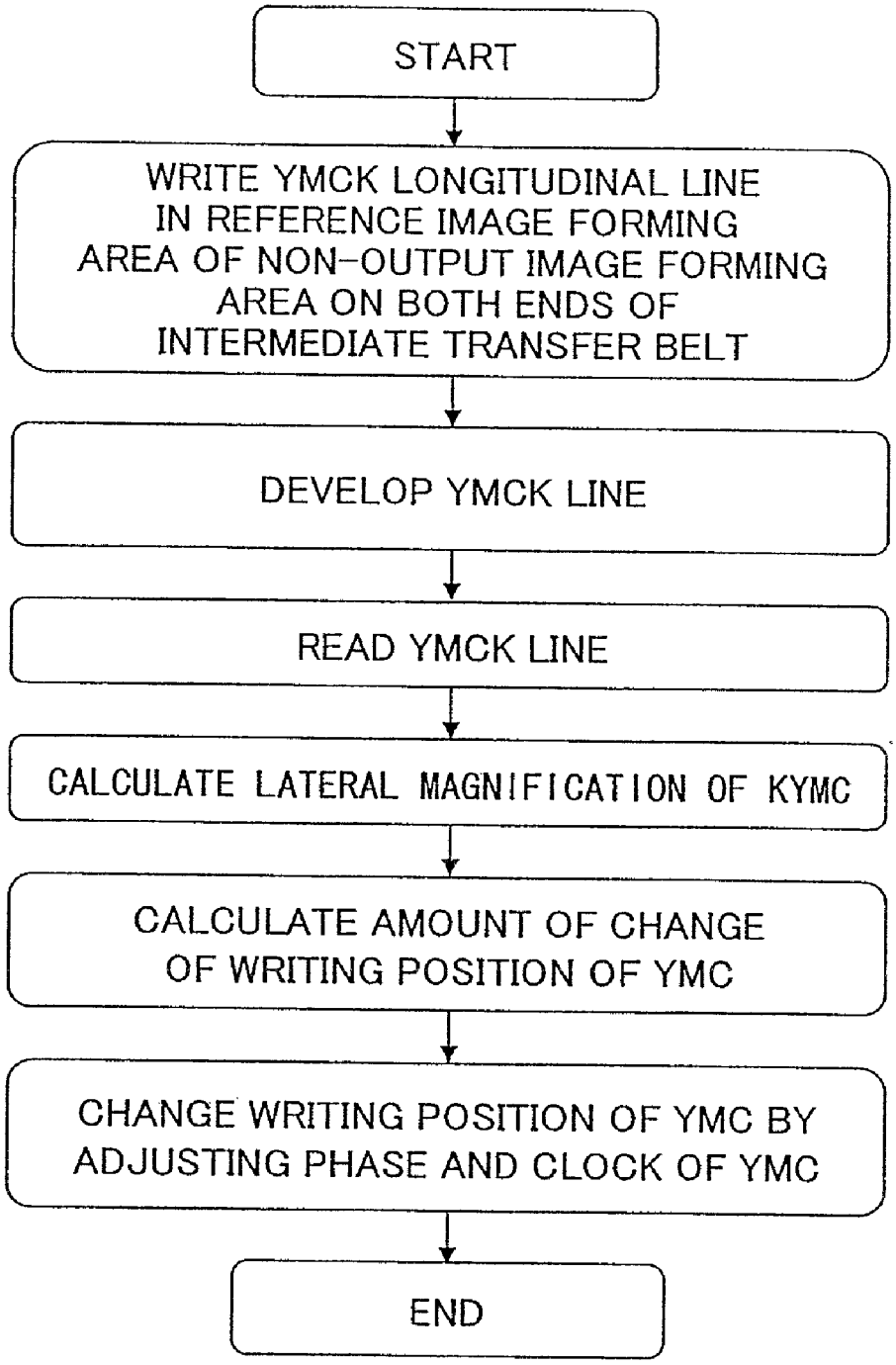
FIG. 8 is a flowchart for describing correction of color registration by using control of lateral magnification according to an embodiment of the present invention.

Furthermore, correction of the amount of color registration during a printing operation can be controlled, for example, by performing writing position control described below with reference to FIGS. 6-8.

(1) Controlling of Writing Position a: skew adjustment b: position matching in sub-scanning direction c: position matching in main-scanning direction With the above-described controlling methods, the amount of adhered toner and the amount of color registration can be controlled within a predetermined value. Thus, color images can be formed having a consistent image quality. In order to respond to various changes such as changes of temperature/humidity during a continuous printing operation or change of a continuous sheet (recording medium), it is particularly important to monitor and control image quality during a printing operation in correspondence with the aforementioned changes.

However, physical quantities (e.g., amount of adhered toner, amount of color registration) of a reference image may differ between a reference image formed in the non-output image forming area 18 (end parts of the intermediate transfer belt 10 in its width direction) and a reference image formed in the output image forming area 17 (center part of the intermediate transfer belt 10) due to factors such as tilt of a development gap in the axial direction of the developing device 6, uneven toner density in the axial direction, or uneven charge of the photoconductor drum 7. In order to relieve the influence of these factors, one embodiment measures image quality of a reference image on both end parts of the intermediate transfer belt 10.

[Correction of Reference Image of Non-Output Image Forming Area]

However, the embodiment of measuring image quality of a reference image on both end parts of the intermediate transfer belt 10 cannot sufficiently correct the amount of adhered toner in the output image forming area 17 and the non-output image forming area 18. Furthermore, without referring to a relationship of color registration amount between the output image forming area 17 and the non-output image forming area 18, the amount of color registration due to bowing or magnification difference between left and right non-output image forming areas 18 cannot be measured and the amount of color registration in the output image forming area 17 cannot be precisely calculated. In other words, since such an embodiment controls image quality based on measurement results of the non-output image forming area 18 being in a condition different from that of the output image forming area 17, image quality cannot be precisely controlled. In general, precision of controlling image quality decreases the longer the image forming apparatus is used.

In order to correct the difference of image quality control between the output image forming area 17 and the non-output image forming area 18, an embodiment of the present invention corrects a reference value of a physical quantity of a reference image 25 by forming a reference image 26 on the photoconductor drum 7 and the output image forming area 17 of the intermediate transfer belt 10 when a printing operation is stopped (e.g., before or after a printing operation), measuring a physical quantity of the reference image 26 with a corresponding sensor 20, comparing the measured physical quantity of the reference image 26 with a measured result obtained from the reference image 25, and correcting the reference value of the physical quantity of the reference image 25 based on the comparison result. Accordingly, image quality during a printing operation is controlled by comparing the corrected reference value and a measured result obtained from the reference image 25 in the non-output image forming area 18 after a printing operation is started. Thereby, image quality can be controlled based on a corrected measurement difference between the reference image 26 of the output image forming area 17 and the reference image 25 of the non-output image forming area 18.

Figure 11:
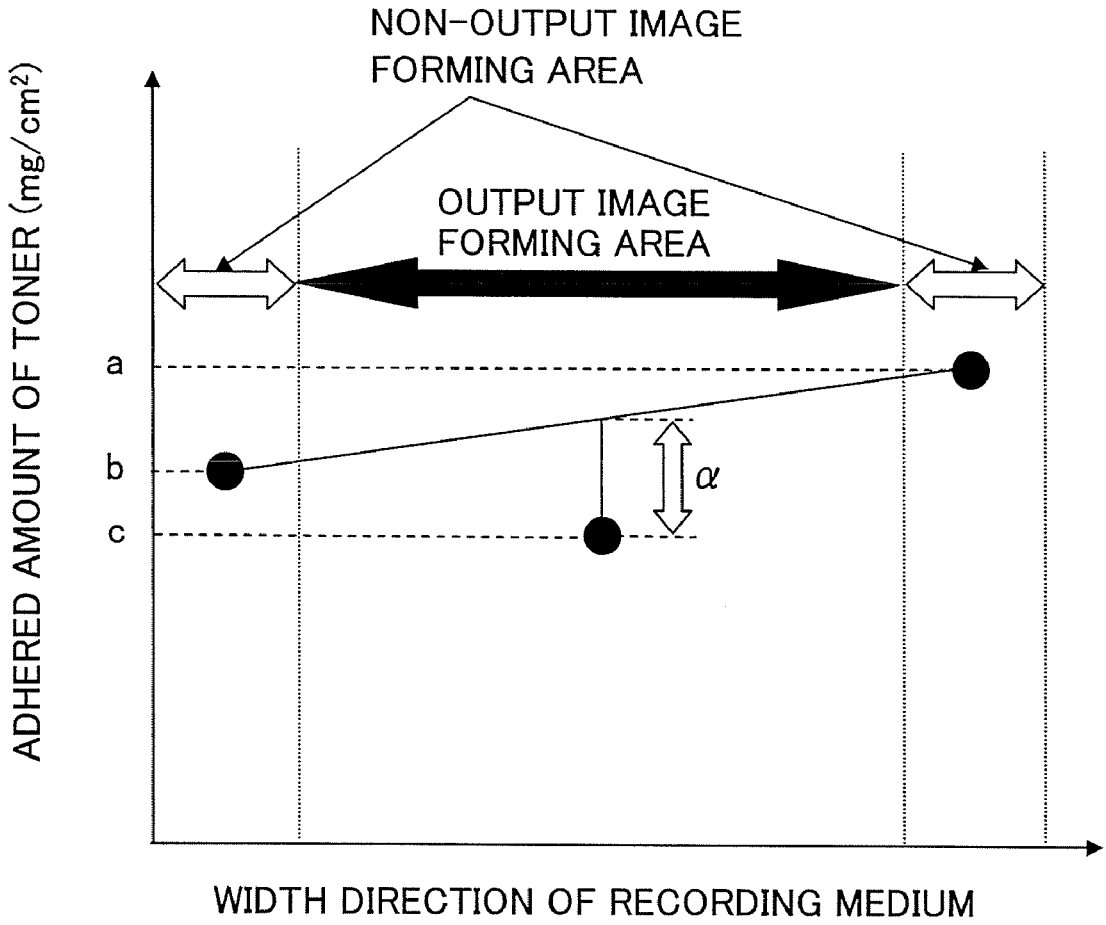
FIG. 11 is a schematic diagram for describing the amount of adhered toner of an intermediate transfer belt according to an embodiment of the present invention.

This embodiment of the present invention is described in more detail by referring to FIG. 11. FIG. 11 illustrates the amount of adhered toner in the non-output image forming area 18 (both end parts) of the intermediate transfer belt 10 and the amount of adhered toner in the output image forming area 17 (center part) of the intermediate transfer belt 10 in a case where a printing operation is stopped. In the example shown in FIG. 11, letters "a" and "b" indicate the amount of adhered toner in the non-output image forming area 18 (both end parts) of the intermediate transfer belt 10, and letter "c" indicates the amount of adhered toner in the output image forming area 17 (center part) of the intermediate transfer belt 10. In this example, the correction amount $\alpha$ (amount for correcting a target reference value) is "$\alpha=(a+b)/2-c$". Accordingly, a corrected target reference value is obtained by adding the correction amount to the target reference value.

For example, in a case where $a=0.45$ mg/cm$^2$, $b=0.55$ mg/cm$^2$, and $c=0.48$ mg/cm$^2$, the correction amount $\alpha$ is "$\alpha=0.5-0.48=0.02$ mg/cm$^2$". Therefore, in a case where the target reference value is 0.5 mg/cm$^2$, the corrected target reference value is $0.5+0.02=0.52$ mg/cm$^2$. Accordingly, image quality is controlled so that a relationship of $(a+b)/2=0.52$ mg/cm$^2$ is satisfied.

(Correction of Color Registration when a Printing Operation is Stopped)

Figure 9:
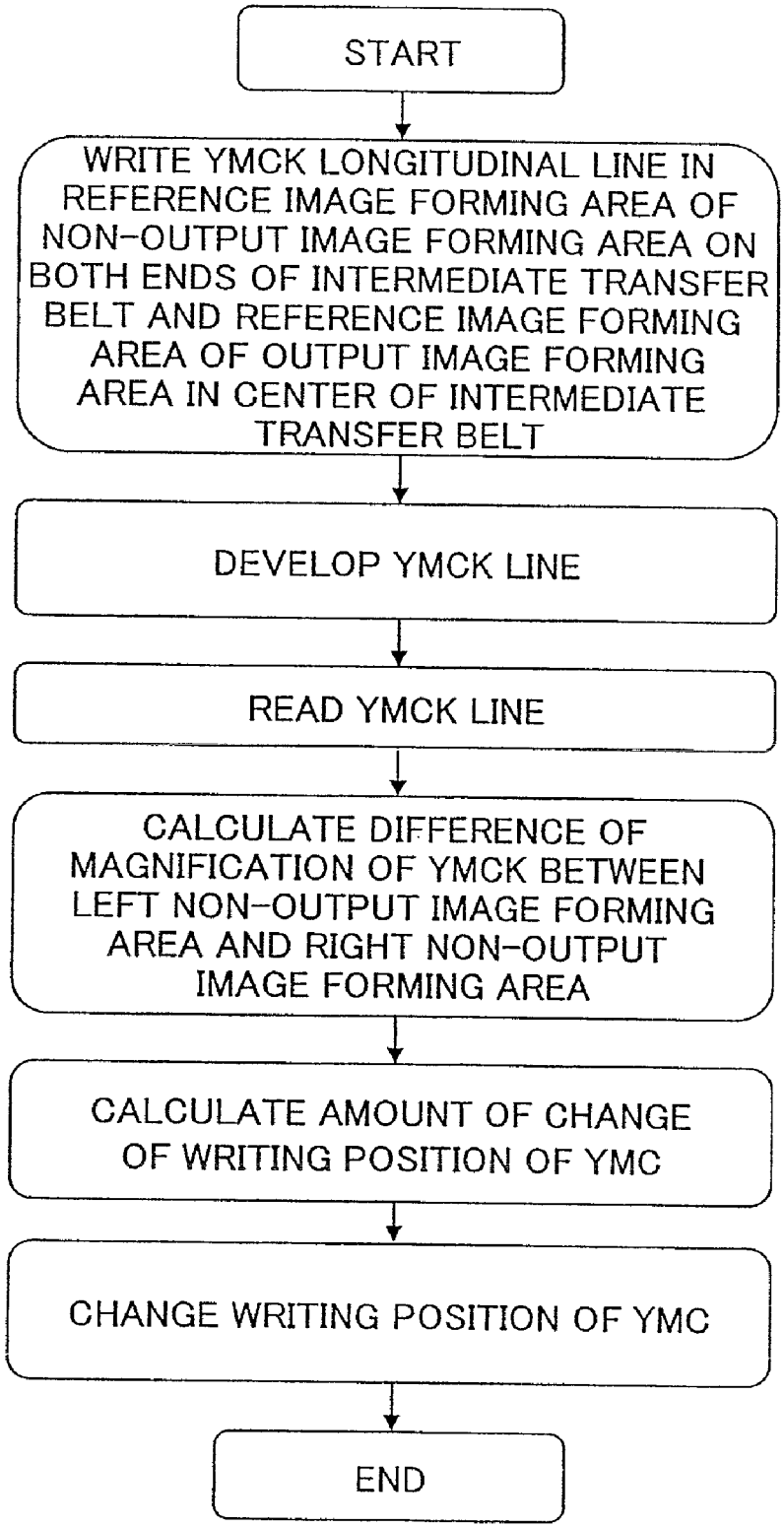
FIG. 9 is a flowchart for describing correction of color registration by using control of magnification difference according to an embodiment of the present invention.
Figure 10:
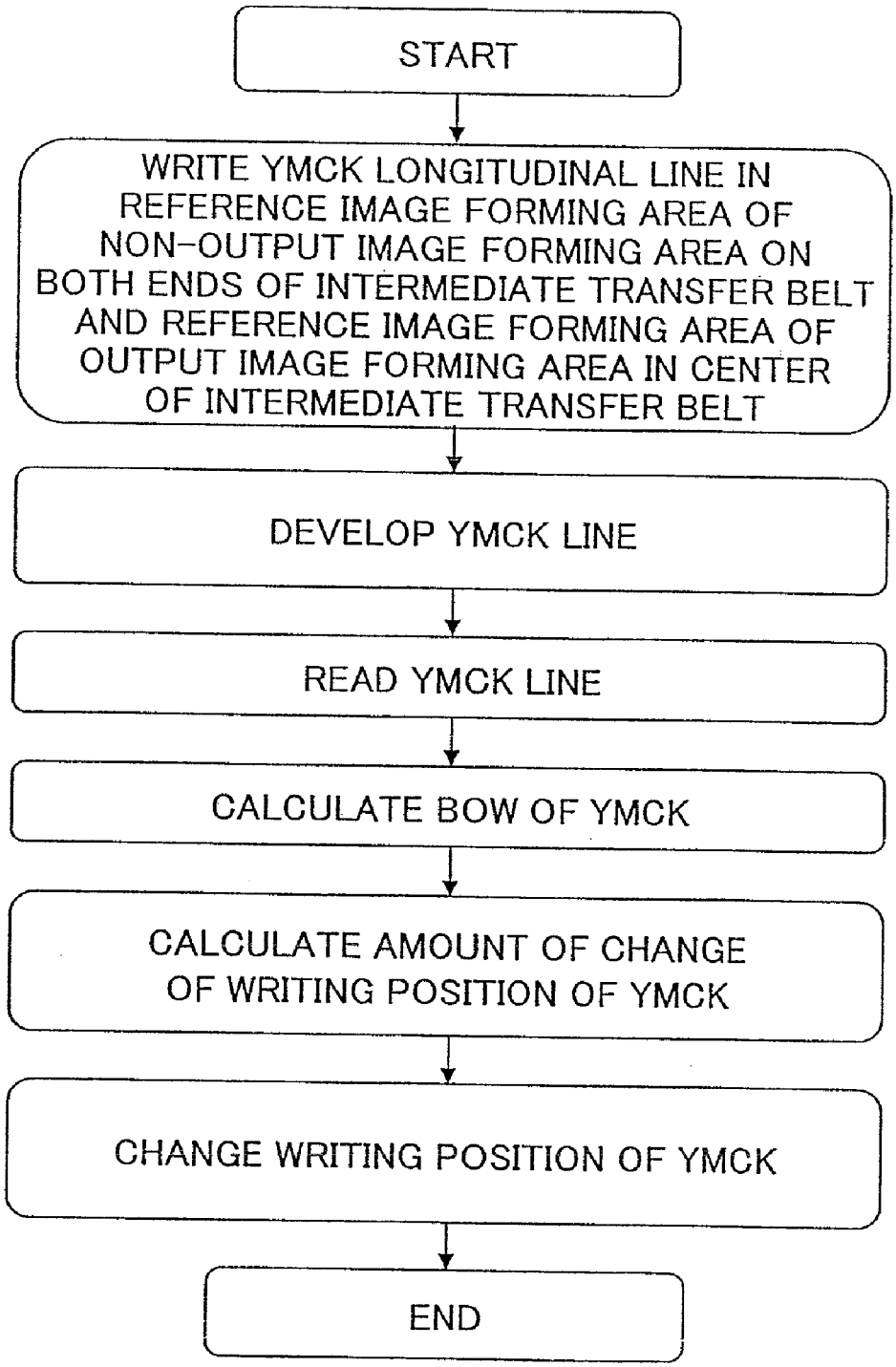
FIG. 10 is a flowchart for describing correction of color registration by using control of bow correction according to an embodiment of the present invention.

According to an embodiment of the present invention, when a printing operation is stopped, a control operation for correcting magnification difference and/or a control operation for correcting bowing (see FIGS. 9 and 10) is performed by forming reference images 25, 26 formed in the output image forming area 17 and the non-output image forming area 18 and measuring color registration from the reference images 25, 26.

(Method of Measuring Physical Quantity of One End (One Side) of the Non-Output Image Forming Area)

Although a Physical Quantity is Measured from the non-output image forming area 18 on both end parts (left and right ends) of the intermediate transfer belt 10 (as shown in FIG. 2) according to the above-described embodiment of the present invention, a physical quantity may be measured from one end part of the non-output image forming area 18. In the case of measuring a physical quantity from one end part of the non-output image forming area 18, the measurement is performed as follows.

For example, in FIG. 2, in a case where the physical quantity is measured from a right end part of the non-output image forming area 18 during a printing operation, the physical quantity is measured from the right end part of the non-output image forming area 18 also when the printing operation is stopped. In other words, measurement performed during a printing operation and measurement performed when the printing operation is stopped are both performed on either one of the left or right end parts of the non-output image forming area 18. It is, however, preferable to measure the physical quantity from both end parts of the non-image forming area 18 for achieving more precise image quality control.

[Forming of Toner Discharge Image]

Figure 4:
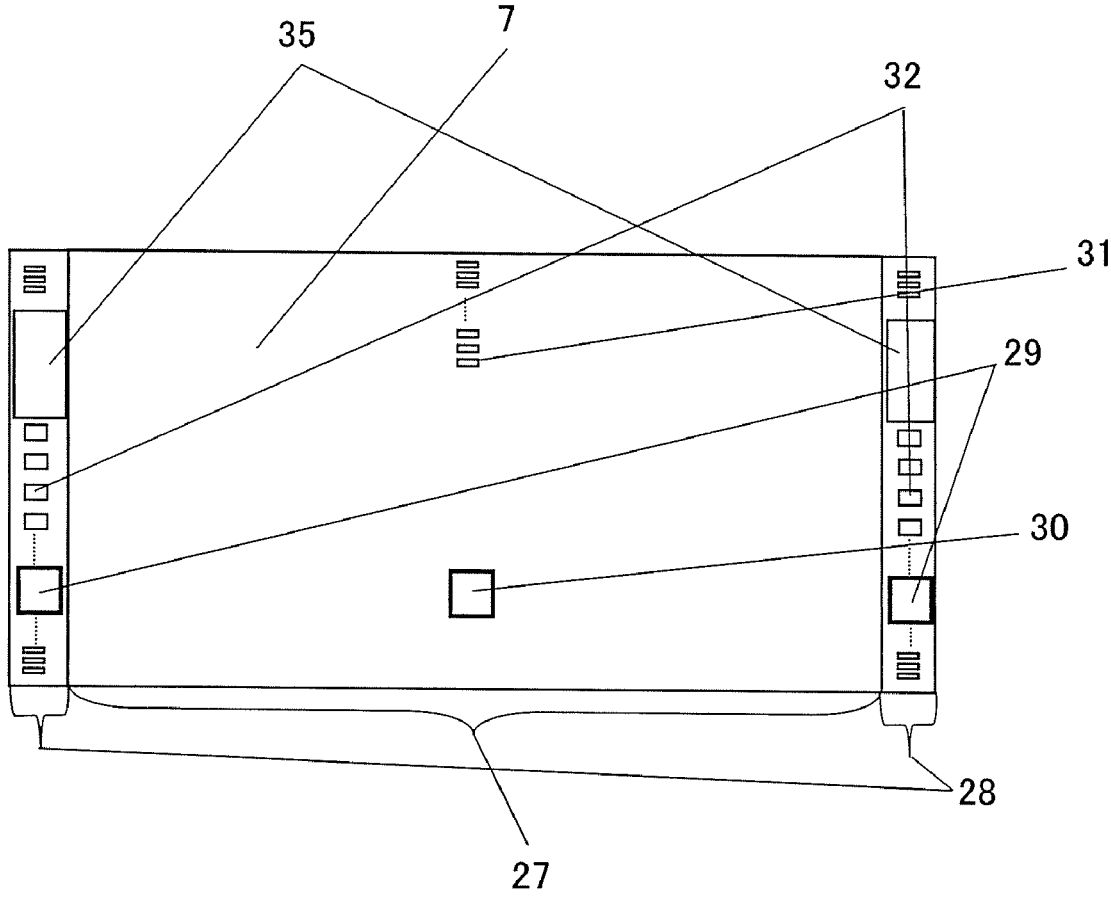
FIG. 4 is a plan view showing a positional relationship between a photoconductor drum and sensors according to an embodiment of the present invention.

In a case of using a high performance image forming apparatus, degradation of image quality due to toner degradation may occur when the discharged amount of toner per unit of time during a printing operation is equal to or less than a predetermined amount. In order to avoid such degradation, toner is forced to be discharged when the consumed amount of toner is less than a predetermined amount. Accordingly, in a case where cut-sheets are used for printing, a toner discharge image is formed in an output image forming area on a photoconductor drum at intervals of output image forming processes. However, in a case where printing is performed continuously (e.g., a case where a continuous form sheet is used for printing), intervals between output image forming processes cannot be obtained. Therefore, in the case where printing is performed continuously, the forced discharging of toner is performed by forming a toner discharge image 35 in a non-output image forming area 28 at the end parts on the photoconductor drum 7 which correspond to the non-output image forming area 18 of the intermediate transfer belt 10 as shown in FIG. 4. In the forced toner discharging process, the toner discharge image 35 formed on the photoconductor drum 7 may be transferred as a toner discharge image 34 onto the non-output image forming area 18 of the intermediate transfer belt 10 (see FIGS. 2 and 4).

The toner discharge images 34, 35 formed on the non-output image forming area 18 of the intermediate transfer belt 10 and the non-output image forming area 28 of the photoconductor drum 7 are removed together with residual toner remaining on the intermediate transfer belt 10 and the photoconductor drum 7 by the belt cleaner 14 for cleaning the intermediate transfer belt 10 and the cleaner 3 for cleaning the photoconductor drum 7, respectively.

Second Embodiment

In the following second embodiment of the present invention, like components are denoted by like reference numerals as of the first embodiment and are not further explained.

Measuring the amount of color registration from a reference image on a photoconductor drum 7 is difficult in a case where only a toner image corresponding to a single color is formed on the photoconductor drum 7. Therefore, it is preferable to measure the amount of color registration from an intermediate transfer belt 10 having superposed toner images corresponding to cyan (C), magenta (M), yellow (Y), and black (K). On the other hand, the amount of adhered toner can be measured from a reference image on a photoconductor drum 7.

Figure 5:
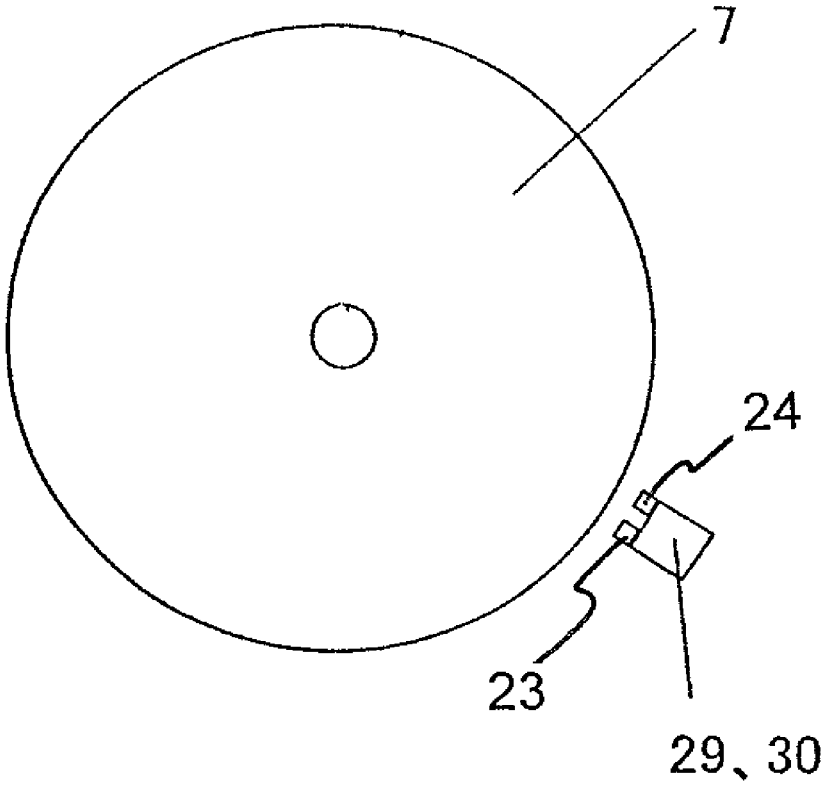
FIG. 5 is a side view of the configuration shown in FIG. 4.

In the image forming apparatus according to the second embodiment of the present invention, reference images 31, 32 are formed on two areas of the photoconductor drum (image carrier) 7 as shown in FIG. 4. FIG. 4 is a plan view of a toner image forming surface of the photoconductor drum 7. FIG. 5 is a side view of the configuration shown in FIG. 4. It is to be noted that FIGS. 4 and 5 also illustrate sensors 29, 30 used for measuring the physical quantity of the reference images 31, 32. As shown in FIG. 4, the reference image 32 is formed in an area outside of an output image forming area 27. That is, the reference image 32 is formed in a non-output image forming area 28 situated at both end parts of the photoconductor drum 7 outside the maximum width of an image transferring area of the photoconductor drum 7 where an output image can be transferred to the continuous sheet 13. The reference image 31 is formed in an area inside the output image forming area 27 situated at the center part of the photoconductor drum 7 where an output image can be transferred to the continuous sheet 13. It is to be noted that, although the reference image 31 according to an embodiment of the present invention is located at a center part inside the output image forming area 27 with respect to the width direction of the photoconductor drum 7, the reference image 31 may be formed in parts other than the center part of the photoconductor drum 7. Furthermore, the reference image 31 may be formed in plural parts of the photoconductor drum 7. Furthermore, although it is preferable to provide the reference image 32 at both end parts of the photoconductor drum 7, the reference image 32 may be provided on either one of the end parts.

By using the photoconductor drum 7 according to this embodiment of the present invention, physical quantities regarding image quality of a reference image can be measured in a substantially same manner as the above-described embodiment of using the intermediate transfer belt 10. As shown in FIG. 4, the sensor 29 is arranged in a manner facing the reference image 32 located in the non-output image forming area 28 (i.e. area outside the output image forming area 27), and the sensor 30 is arranged in a manner facing the reference image 31 located in the output image forming area 27 (i.e. area inside the output image forming area 27). The sensors 29 and 30 are mounted (supported) on a main body of the image forming apparatus 100. Thus, the sensors 29 and 30 constantly face substantially the same area of the photoconductor drum 7 with respect to the width direction of the photoconductor drum 7 even where the photoconductor drum 7 is rotated. Accordingly, as shown in FIGS. 4 and 5, the reference images 31 and 32 are successively conveyed to the area facing the sensors 29, 30 along with the rotation of the photoconductor drum 7. The same as sensors 19, 20 of the first embodiment of the present invention, each of the sensors 29 and 30 is configured as a non-contact type sensor including a light emitting part 23 and a light receiving part 24. The sensors 29, 30 may be optical sensors used for specular reflection where the angle of incidence equals the angle of reflection or optical sensors used for diffused reflection where incoming light is reflected in a broad range of directions.

It is to be noted that measuring the amount of adhered toner from the reference images 31, 32 on the photoconductor drum 7 is performed on each photoconductor drum 7 for forming toner images of cyan (C), magenta (M), yellow (Y), and black (K).

It is to be noted that measuring of physical quantity in the second embodiment of the present invention is performed in substantially the same manner as the measuring process performed with the intermediate transfer belt 10 of the first embodiment of the present invention. That is, physical quantities are measured by referring to a reference image in the non-output image forming area 28 during printing and by referring to both the reference image 31 of the output image forming area 27 and the reference image 32 of the non-output image forming area 28 when the printing operation is stopped. Alternative measuring methods and other measuring target (reference images) other than those used for measuring color registration are substantially the same as the intermediate transfer belt 10 of the first embodiment of the present invention.

Next, a process of forming a toner discharge image according to the second embodiment of the present invention is described. In the second embodiment of the present invention, forced discharging of toner is performed by forming a toner discharge image 35 in a non-output image forming area 28 at the end parts on the photoconductor drum 7. In the forced toner discharging process, the toner discharge image 35 formed on the photoconductor drum 7 may be transferred as a toner discharge image 34 onto the non-output image forming area 18 of the intermediate transfer belt 10 (see FIGS. 2 and 4).

The toner discharge images 34, 35 formed on the non-output image forming area 18 of the intermediate transfer belt 10 and the non-output image forming area 28 of the photoconductor drum 7 are removed together with residual toner remaining on the intermediate transfer belt 10 and the photoconductor drum 7 by the belt cleaner 14 for cleaning the intermediate transfer belt 10 and the cleaner 3 for cleaning the photoconductor drum 7.

Third Embodiment

In the following third embodiment of the present invention, like components are denoted by like reference numerals as of the first and second embodiments and are not further explained.

As described above with the first and second embodiments of the present invention, the amount of adhered toner can be measured by using the reference images on the photoconductor drum 7 or the intermediate transfer belt 10. In the case where the amount of adhered toner is measured by referring to the reference images on the intermediate transfer drum 7, the output image forming area 17 of the intermediate transfer belt 10 is substantially constantly in contact with a continuous sheet whereas the non-output image forming area 18 is not in constant contact with the continuous sheet. Therefore, in a case where the image forming apparatus 100 is continuously operated for a long period for printing the continuous sheet, the rate of age deterioration at the surface of the output image forming area 17 becomes different from that at the surface of the non-output image forming area 18 when the length of the printed continuous sheet surpasses a predetermined length (e.g., 1 km). This causes the efficiency of the first transfer process to become different at the output image forming area 17 and at the non-output image forming area 18. This results in an error of the correlation between data of the amount of adhered toner measured from the non-output image forming area 18 and the amount of adhered toner obtained from the output image forming area 17. This lowers the precision of controlling the amount of adhered toner with respect to an output image.

In order to prevent this problem, this embodiment of the present invention measures the amount of adhered toner from the intermediate transfer belt 10 until the length of the printed sheet (recording medium) reaches a predetermined value (e.g., 1 km). In a case of performing a printing operation beyond the predetermined value, a reference image is formed on the photoconductor drum 7 and the amount of adhered toner is measured from the reference image formed on the photoconductor drum 7. Although the target for measuring the amount of adhered toner (measuring target) is changed when the length of the recording medium reaches a predetermined value (e.g., 1 km) according to this embodiment of the present invention, the predetermined value may be changed depending on the image forming apparatus 100 or the image quality desired. For example, the predetermined value may be selected from a range between 500 m to 2 km.

In the third embodiment of the present invention, the method of measuring physical quantities (e.g., adhered amount of toner, amount of color registration) or the forced toner discharging method is substantially the same as that of the above-described first and second embodiments of the present invention.

Fourth Embodiment

In the following fourth embodiment of the present invention, 4 or more sensors are used for measurement. In the fourth embodiment of the present invention, like components are denoted by like reference numerals as of the first, second, and third embodiments and are not further explained.

Figure 12:
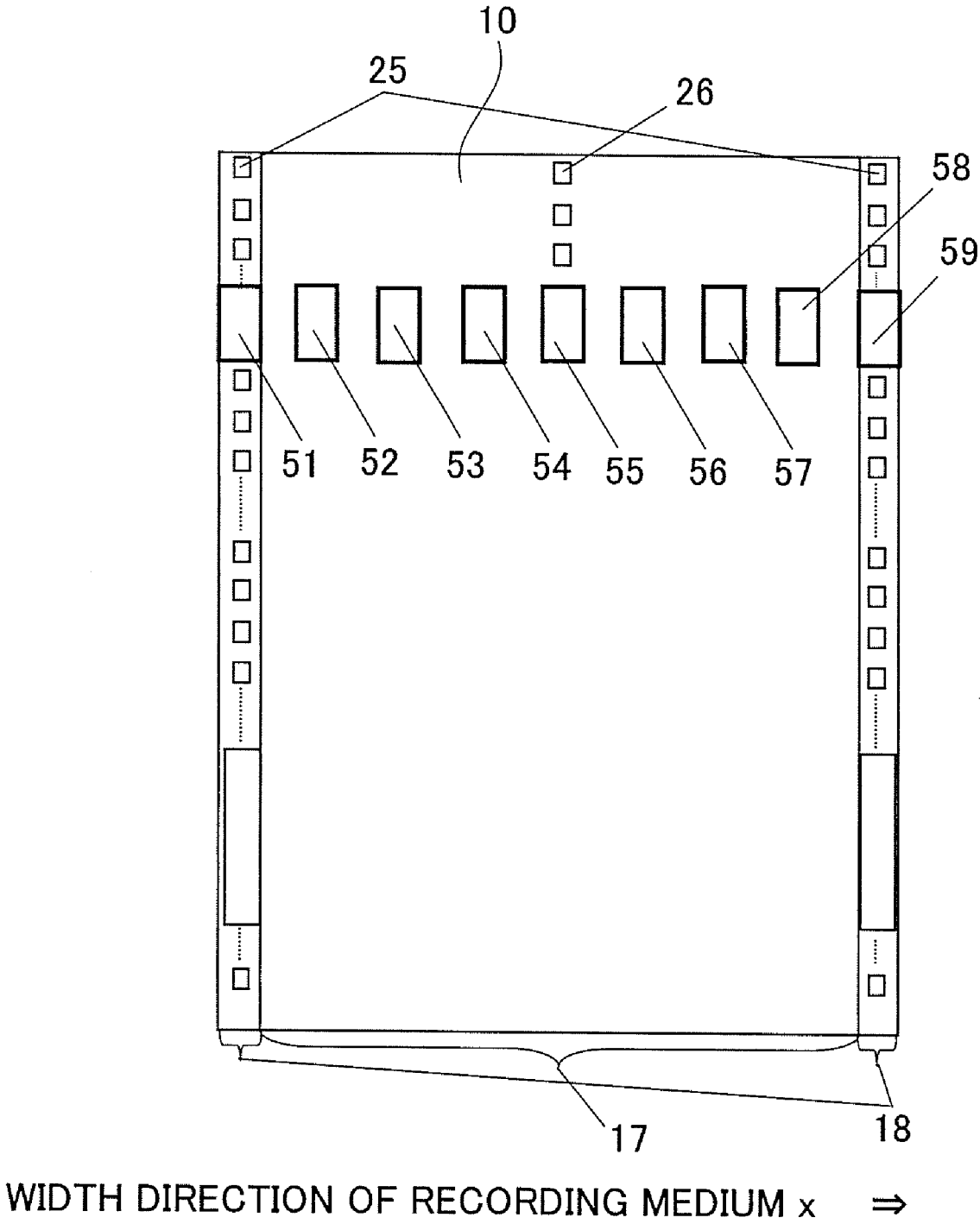
FIG. 12 is a plan view showing a positional relationship between an intermediate transfer belt and sensors according to another embodiment of the present invention.
Figure 13:
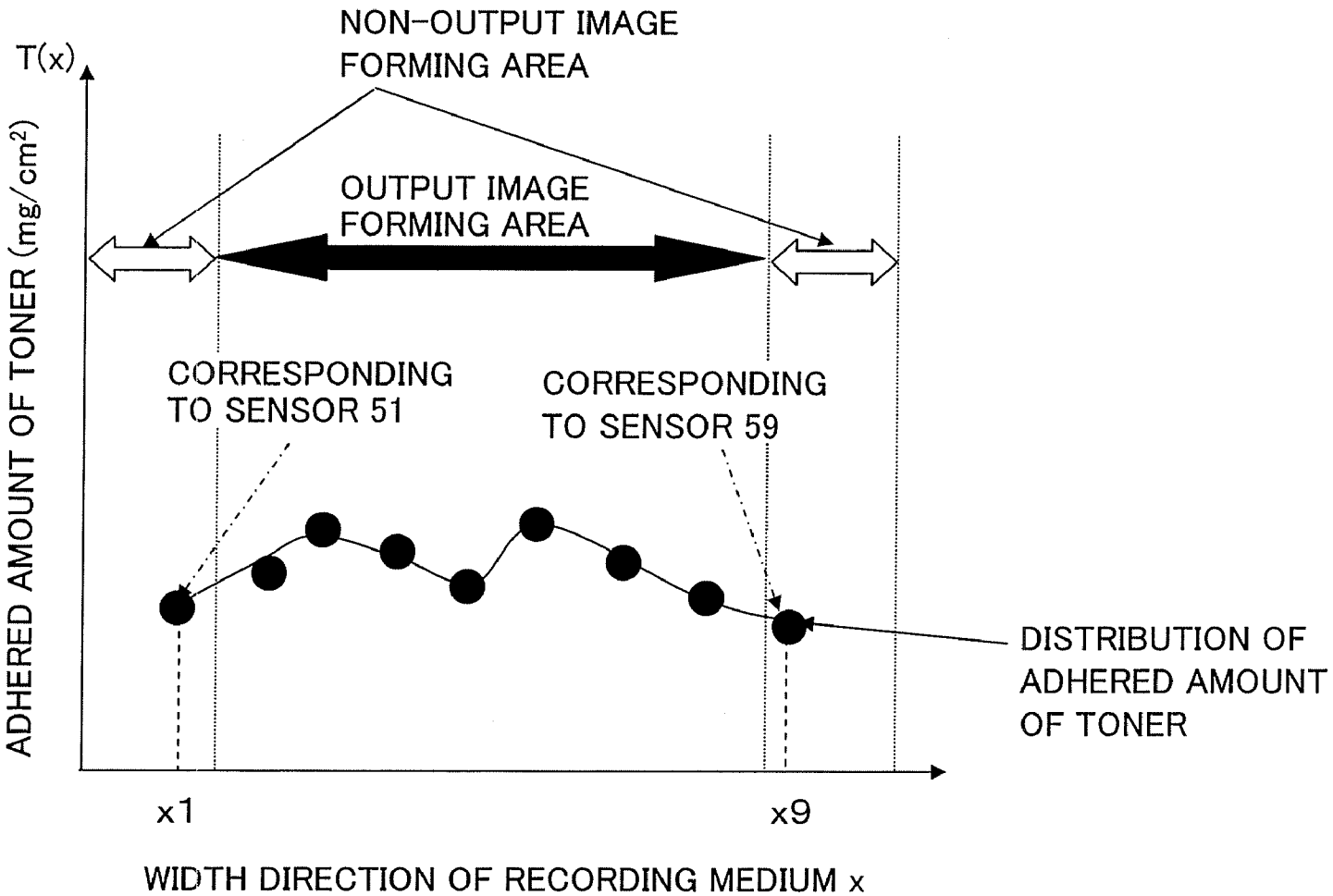
FIG. 13 is a schematic diagram for describing distribution of the amount of adhered toner in a case where plural sensors are provided in correspondence with an intermediate transfer belt according to an embodiment of the present invention.

By using plural sensors, measurement corresponding to changes of sheet width can be achieved, and measurement can be performed with higher precision. As shown in FIG. 12, plural sensors 51-59 are provided above the intermediate transfer belt 10 according to this embodiment of the present invention. The sensors 51-59 are aligned from end to end in the width direction of the intermediate transfer belt 10. It is preferable that the number of sensors be no less than 4. In the exemplary configuration shown in FIG. 12, 9 sensors 51-59 are used (for the sake of explanation) and the intervals (space) between the sensors are equal. However, the present invention is not limited to the configuration shown in FIG. 12. As shown in FIGS. 12 and 13, the lateral position of each of the sensors 51-59 is assumed as measuring position x1-x9 according to the x axis (e.g., position x1 corresponds to the sensor 51, position x4 corresponds to the sensor 54, position x9 corresponds to the sensor 59), and the physical quantities measured by sensors 51-59 are assumed as T(x1)-T(x9). At this stage, a continuous sheet 13 is not yet conveyed to an image transferring (printing) area facing the intermediate transfer belt 10. The maximum width of the continuous sheet 13 is to be within the space between the sensors 51, 59 on both ends of the plural sensors. The minimum width of the continuous sheet 13 is not limited in particular as long as it is within the space between the sensors 51, 59 on both ends of the plural sensors. However, according to this embodiment of the present invention, the width and position of the continuous sheet 13 is supplied beforehand from a controller or the like.

Next, a method of measuring a physical quantity (in this example, amount of adhered toner) according to the fourth embodiment of the present invention is described. Although a single sensor is provided in correspondence with the output image forming area 17 as shown in FIG. 2, this embodiment provides 7 sensors corresponding to the output image forming area 17 as shown in FIG. 12. A total of 9 sensors including sensors 51, 59 corresponding to the non-output image forming area 18 are provided.

Before a printing operation is started, the physical quantity (in this example, amount of adhered toner) in the output image forming area 17 and the physical quantity (in this example, amount of adhered toner) in the non-output image forming area 18 are measured. FIG. 13 is a schematic diagram for describing distribution of a physical quantity (in this example, amount of adhered toner) in a case where plural sensors are provided in correspondence with the intermediate transfer belt 10.

The distribution of physical quantity in the output image forming area 17 and the non-output image forming area 18 is approximate to the n th order function according to a method of least squares n>=2).

$$T(x)=f(x)+\beta x+\gamma \quad \text{[Formula 1]}$$

It is to be noted that "f(x)" is a polynomial expression comprising a term equal to or greater the second order. The coefficients β and γ are determined by calculating the physical quantity of a predetermined position with respect to the width of the continuous sheet (recording medium) 13 (described in detail below). A physical quantity T(x) corresponding to a given position x with respect to a width (x) direction of the continuous sheet 13 can be obtained by using (Formula 1).

Since the continuous sheet 13 is positioned in the output image forming area 17 during a printing operation, the physical quantity is measured by using the sensors 51 and 59 located in the non-output image forming area 18. In this case, the physical quantities measured from the sensors 51 and 59 are expressed as "T(x1)" and "T(x9)", respectively. Accordingly, the following Formulas 2 and 3 can be obtained by applying Formula 1 to T(x1) and T(x9).

$$T(x1)=f(x1)+\beta x1+\gamma \quad \text{[Formula 2]}$$

$$T(x9)=f(x9)+\beta x9+\gamma \quad \text{[Formula 3]}$$

Accordingly, coefficients β and γ can be determined from the measured values T(x1) and T(x9).

Therefore, even in a case where continuous papers 13 having different widths are used, a new physical quantity T(x) corresponding to a given position x in the width x direction of the continuous paper 13 can be obtained. Thereby, the obtained physical quantity can be used to perform, for example, shading control.

Figure 14:
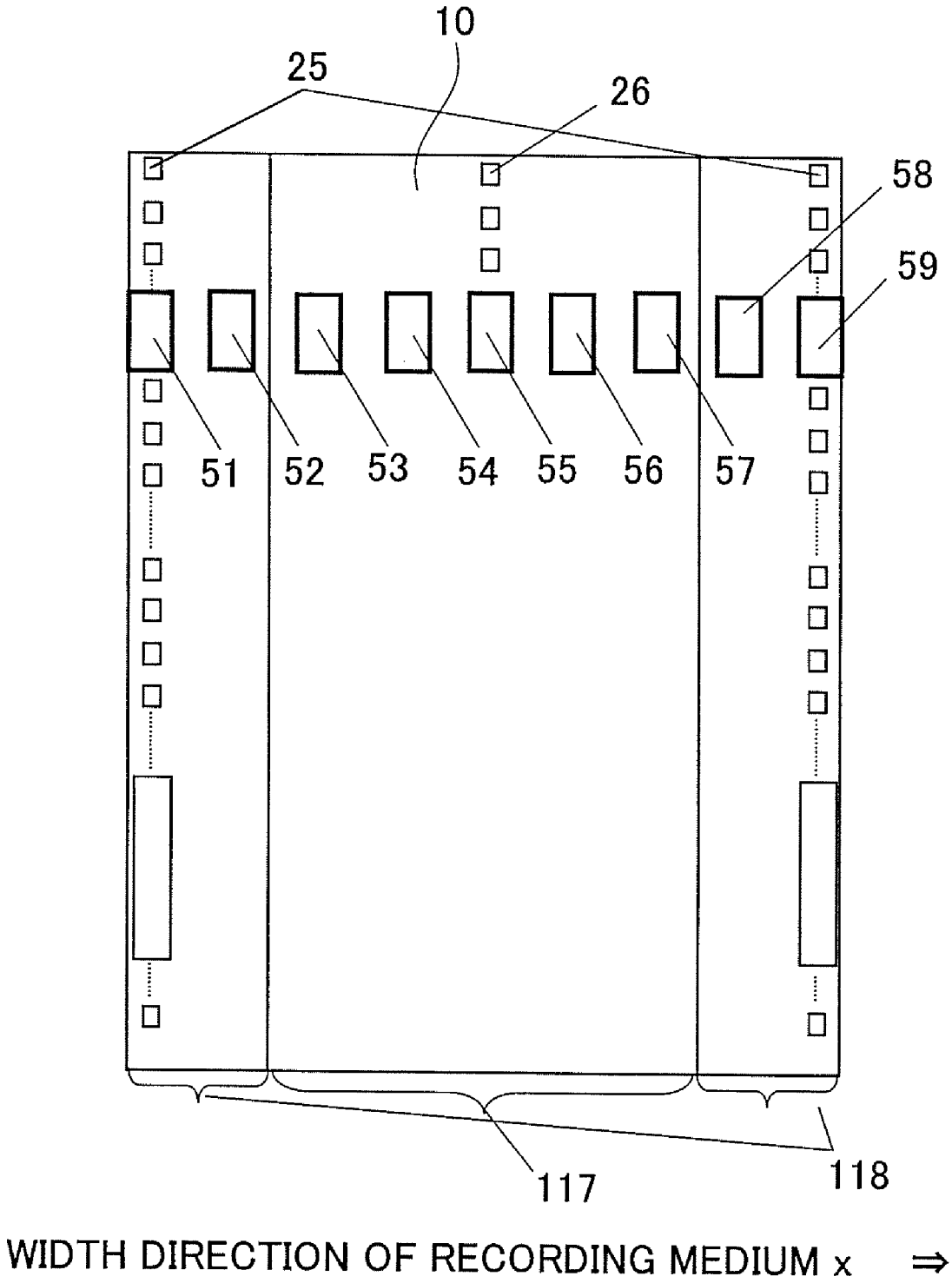
FIG. 14 is a plan view showing a positional relationship between an intermediate transfer belt and sensors in a case where the width of a continuous sheet is changed according to an embodiment of the present invention.

Next, an exemplary case of using continuous papers 13 having different widths is described. In the following exemplary case, the physical quantity that is measured is the amount of adhered toner. FIG. 14 is a plan view showing the intermediate transfer belt 10 along with 9 sensors as shown in FIG. 12 in a case where the width of the continuous sheet 13 is changed. The width of the continuous sheet 13 used in FIG. 14 is less than the width of the continuous sheet 13 used in FIG. 12. Therefore, in this case, the output image forming area 17 is indicated as an output image forming area 117, and the non-output image forming area 18 is indicated as a non-output image forming area 118. In this case, sensors 53-57 are used for measuring corresponding reference images 26 in the output image forming area 117. Furthermore, sensors 52, 58, which are situated immediately aside the corresponding ends of the continuous paper 13, are used for measuring corresponding reference images 25 in the non-output image forming area 118. Furthermore, sensors 51 and 59 are not used in this case.

Figure 15:
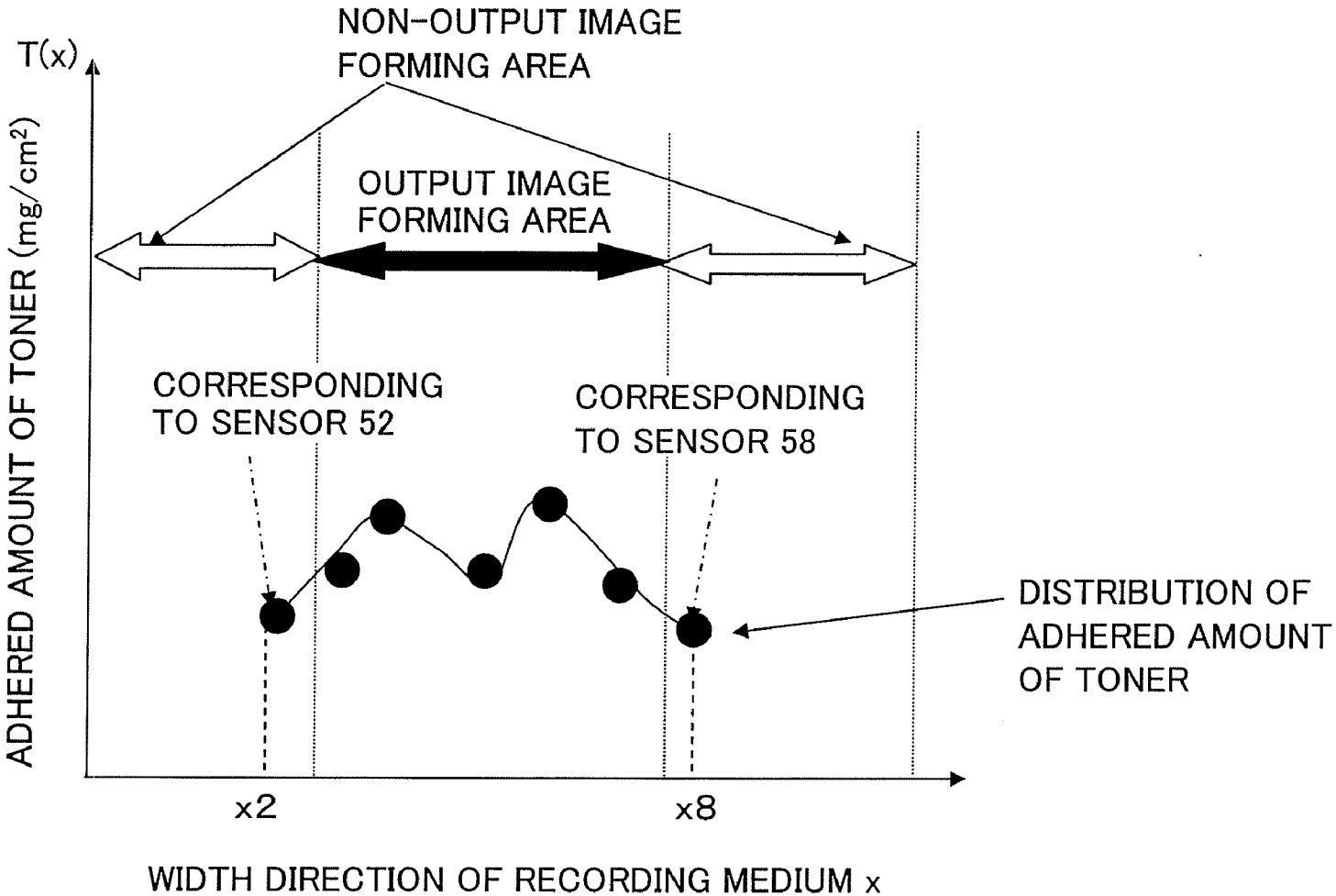
FIG. 15 is a schematic diagram for describing distribution of the amount of adhered toner in a case where plural sensors are provided in correspondence with an intermediate transfer belt when the width of a continuous sheet is changed according to an embodiment of the present invention.

Before a printing operation is started, the reference images 26 are formed at positions corresponding to the sensors 52-58. Then, before the printing operation is started, the physical quantities of the reference images 25, 26 in the output image forming area 117 and the non-output image forming area 118 are measured by 7 corresponding sensors 52-58. FIG. 15 is schematic diagram for describing distribution of a physical quantity (in this example, amount of adhered toner) in a case where plural sensors are provided in correspondence with the intermediate transfer belt 10 when the width of the continuous sheet 13 is changed.

The distribution of physical quantity in the output image forming area 117 and the non-output image forming area 118 is approximate to the n th order function according to a method of least squares (n>=2).

$$T'(x)=f'(x)+\beta'x+\gamma' \quad \text{[Formula 4]}$$

It is to be noted that "f'(x)" is a polynomial expression comprising a term equal to or greater the second order. The coefficients β' and γ' are determined by calculating the physical quantity of a predetermined position with respect to the width of the continuous sheet (recording medium) 13 (described in detail below). A physical quantity T(x) corresponding to a given position x with respect to a width (x) direction of the continuous sheet 13 can be obtained by using (Formula 4).

Since the continuous sheet 13 is positioned in the output image forming area 117 during a printing operation, the physical quantity is measured by using the sensors 52 and 58 located in the non-output image forming area 118. In other words, even in a case where the reference images 26 were formed in positions corresponding to the sensors 52 and 58, the reference images 26 would not be transferred to the continuous sheet 13. In this case, the physical quantities measured from the sensors 52 and 58 are expressed as "T'(x2)" and "T'(x8)", respectively. Accordingly, the following Formulas 5 and 6 can be obtained by applying Formula 4 to T'(x2) and T'(x8).

$$T'(x2)=f'(x2)+\beta'x2+\gamma' \quad \text{[Formula 5]}$$

$$T'(x8)=f'(x8)+\beta'x8+\gamma' \quad \text{[Formula 3]}$$

Accordingly, coefficients β' and γ' can be determined from the measured values T'(x2) and T'(x8). Therefore, even in a case where continuous papers 13 having different widths are used, a new physical quantity T'(x) corresponding to a given position x in the width x direction of the continuous paper 13 can be obtained. Thereby, the obtained physical quantity can be used to perform, for example, shading control.

Thus, in the above-described fourth embodiment of the present invention, measurement within the output image forming area can be improved by increasing the number of sensors. Furthermore, even in a case where continuous sheets having different widths are used, a physical quantity can be measured with high precision by using, for example, a selecting part provided in the image quality controlling device 60 for selecting a suitable sensor in accordance with the width of the continuous sheet. Although the fourth embodiment of the present invention is applied to the intermediate transfer belt 10, the fourth embodiment of the present invention may also be applied to the photoconductor drum 7.

The image forming apparatus and the image forming method according to the above-described embodiments of the present invention can be effectively used for an electrophotographic type printing machine or a copier capable of performing continuous printing operations. More particularly, the image forming apparatus and the image forming method according to the above-described embodiments of the present invention can be suitably used for high-speed, large scale continuous printing machines required to perform high speed and high quality image forming operations for a certain period of time.

With the above-described embodiments of the present invention, an image forming apparatus and an image forming method capable of forming images while substantially constantly monitoring image quality even in a case of continuously forming images (e.g., printing on continuous form paper).

The present invention is not limited to the specifically disclosed embodiments, and variations and modifications may be made without departing from the scope of the present invention.

The present application is based on Japanese Priority Application Nos. 2007-159033, 2007-159034, and 2008-136856 filed on Jun. 15, 2007, Jun. 15, 2007 and May 26, 2008, respectively, with the Japanese Patent Office, the entire contents of which are hereby incorporated herein by reference.

What is claimed is:

1. An image forming apparatus for performing an image forming operation, the image forming apparatus comprising:

an image carrier on which a toner image is formed;

an intermediate transfer member configured to transfer the toner image to a recording medium, the intermediate transfer member having a toner image forming area including an output image forming area and a non-output image forming area located outside of the output image forming area, the toner image forming area being wider than the output image forming area; and a detecting part configured to measure a physical quantity regarding an image quality of a first reference image formed in the output image forming area and a second reference image formed in the non-output image forming area.

2. The image forming apparatus as claimed in claim 1, wherein the physical quantity is an amount of adhered toner in the first reference image or the second reference image.

3. The image forming apparatus as claimed in claim 1, wherein the physical quantity is an amount of color registration in the first reference image or the second reference image.

4. The image forming apparatus as claimed in claim 1, further comprising:

an image quality controlling device configured to correct a reference value of the physical quantity of the second reference image according to the physical quantity of the first reference image when the image forming operation is stopped and control the image quality of an output image to be formed in the output image forming area according to the corrected reference value and the physical quantity of the second reference image.

5. The image forming apparatus as claimed in claim 1, further comprising:

a toner discharge image forming part configured to form a toner discharge image;

wherein the image carrier has a toner discharge image forming area corresponding to the non-output image forming area of the intermediate transfer member;

wherein the toner discharge image is formed in at least one of the toner discharge image forming area of the image carrier and the non-output image forming area of the intermediate transfer member.

6. The image forming apparatus as claimed in claim 1, further comprising:

three or more of the detecting parts configured to measure the physical quantity regarding the image quality of a corresponding reference image; and a selecting part configured to select the detecting part located in the output image forming area and two of the detecting parts located closest to the corresponding ends of the recording medium in the non-image forming area when the width of the output image forming area and the width of the non-output image forming area are changed in correspondence with a change of width of the recording medium;

wherein the selected detecting part measures the physical quantity regarding the image quality of a corresponding reference image when the image forming operation is stopped.

7. An image forming method for performing an image forming operation, the image forming method comprising the steps of:

forming a toner image on an image carrier;

transferring the toner image to a recording medium via an intermediate transfer member having a toner image forming area including an output image forming area and a non-output image forming area located outside of the output image forming area, the toner image forming area being wider than the output image forming area; and measuring a physical quantity regarding an image quality of a first reference image formed in the output image forming area and a second reference image formed in the non-output image forming area.

8. The image forming method as claimed in claim 7, wherein the physical quantity is at least one of an amount of adhered toner and an amount of color registration.

9. The image forming method as claimed in claim 7, further comprising the steps of:

correcting a reference value of the physical quantity of the second reference image according to the physical quantity of the first reference image when the image forming operation is stopped; and controlling the image quality of an output image to be formed in the output image forming area according to the corrected reference value and the physical quantity of the second reference image.

10. The image forming method as claimed in claim 7, further comprising a step of:

forming a toner discharge image;

wherein the image carrier has a toner discharge image forming area corresponding to the non-output image forming area of the intermediate transfer member;

wherein the toner discharge image is formed in at least one of the toner discharge image forming area of the image carrier and the non-output image forming area of the intermediate transfer member.

11. An image forming apparatus for performing an image forming operation, the image forming apparatus comprising:

an image carrier on which a toner image is formed, the image carrier having a first toner image forming area including a first output image forming area and a first non-output image forming area located outside of the first output image forming area, the first toner image forming area being wider than the first output image forming area;

an intermediate transfer member configured to transfer the toner image to a recording medium, the intermediate transfer member having a second toner image forming area including a second output image forming area and a second non-output image forming area located outside of the second output image forming area, the second toner image forming area being wider than the second output image forming area; and a detecting part configured to measure a physical quantity regarding an image quality of a first reference image formed in the first and second output image forming areas and a second reference image formed in the first and second non-output image forming areas.

12. The image forming apparatus as claimed in claim 11, wherein the physical quantity regarding the image quality of the first reference image formed on the intermediate transfer member is an amount of adhered toner in the first reference image formed on the intermediate transfer member and the physical quantity regarding the image quality of the second reference image formed on the intermediate transfer member is an amount of adhered toner in the second reference image formed on the intermediate transfer member.

13. The image forming apparatus as claimed in claim 11, wherein the physical quantity regarding the image quality of the first reference image formed on the image carrier is an amount of color registration in the first reference image formed on the image carrier and the physical quantity regarding the image quality of the second reference image formed on the image carrier is an amount of color registration in the second reference image formed on the image carrier.

14. The image forming apparatus as claimed in claim 11, further comprising:

an image quality controlling device configured to correct a reference value of the physical quantity of the second reference image according to the physical quantity of the first reference image when the image forming operation is stopped and control the image quality of an output image to be formed in the output image forming area according to the corrected reference value and the physical quantity of the second reference image.

15. The image forming apparatus as claimed in claim 11, further comprising:

a toner discharge image forming part configured to form a toner discharge image;

wherein the image carrier has a toner discharge image forming area corresponding to the second non-output image forming area of the intermediate transfer member;

wherein the toner discharge image is formed in at least one of the toner discharge image forming area of the image carrier and the second non-output image forming area of the intermediate transfer member.

16. The image forming apparatus as claimed in claim 11, wherein the detecting part is configured to measure the physical quantity regarding the image quality of the first reference image formed in the second output image forming area until the length of the recording medium on which the image forming operation is performed reaches a predetermined length and measure the physical quantity regarding the image quality of the reference images of the intermediate transfer member until the length of the recording medium on which the image forming operation is performed is no greater than a predetermined length and measure the physical quantity regarding the image quality of the reference images of the image carrier after the length of the recording medium on which the image forming operation is performed is greater than the predetermined length.

17. The image forming apparatus as claimed in claim 16, wherein the predetermined length ranges from 500 m to 2 km.

18. An image forming method for performing an image forming operation, the image forming method comprising the steps of:

forming a toner image on an image carrier, the image carrier having a first toner image forming area including a first output image forming area and a first non-output image forming area located outside of the first output image forming area, the first toner image forming area being wider than the first output image forming area;

transferring the toner image to a recording medium with an intermediate transfer member, the intermediate transfer member having a second toner image forming area including a second output image forming area and a second non-output image forming area located outside of the second output image forming area, the second toner image forming area being wider than the second output image forming area; and measuring a physical quantity regarding an image quality of a first reference image formed in the first and second output image forming areas and a second reference image formed in the first and second non-output image forming areas.

19. The image forming method as claimed in claim 18, wherein the physical quantity regarding the image quality of the first reference image formed on the intermediate transfer member is an amount of color registration in the first reference image formed on the intermediate transfer member and the physical quantity regarding the image quality of the second reference image formed on the intermediate transfer member is an amount of color registration in the second reference image formed on the intermediate transfer member, wherein the physical quantity regarding the image quality of the first reference image formed on the image carrier is an amount of adhered toner in the first reference image formed on the image carrier and the physical quantity regarding the image quality of the second reference image formed on the image carrier is an amount of adhered toner in the second reference image formed on the image carrier.

20. The image forming method as claimed in claim 18, further comprising the steps of:

correcting a reference value of the physical quantity of the second reference image according to the physical quantity of the first reference image when the image forming operation is stopped; and controlling the image quality of an output image to be formed in the output image forming area according to the corrected reference value and the physical quantity of the second reference image.

* * * * *